US005864812A

United States Patent [19]

Kamai et al.

[11] Patent Number: 5,864,812

[45] Date of Patent: Jan. 26, 1999

[54] SPEECH SYNTHESIZING METHOD AND APPARATUS FOR COMBINING NATURAL SPEECH SEGMENTS AND SYNTHESIZED SPEECH SEGMENTS

[75] Inventors: Takahiro Kamai, Osaka; Kenji Matsui, Nara; Noriyo Hara, Osaka, all of Japan

[73] Assignee: Matsushita Electric Industrial Co., Ltd., Osaka, Japan

[21] Appl. No.: 565,401

[22] Filed: Nov. 30, 1995

[30] Foreign Application Priority Data

Dec. 6, 1994 [JP] Japan ..... 6-302471
Aug. 30, 1995 [JP] Japan ..... 7-220963

[51] Int. Cl.[6] ..... G10L 5/02

[52] U.S. Cl. ..... 704/268; 704/258; 704/267

[58] Field of Search ..... 704/200, 201, 704/258, 268, 369; 707/100

[56] References Cited

U.S. PATENT DOCUMENTS 4,685,135 8/1987 Lin et al. ..... 704/260
5,208,897 5/1993 Hutchins ..... 704/200
5,400,434 3/1995 Pearson ..... 704/264
5,577,249 11/1996 Califano ..... 707/100
5,617,507 4/1997 Lee et al. ..... 704/200
5,704,007 12/1997 Cecys ..... 395/2.69

*Primary Examiner*—David R. Hudspeth
*Assistant Examiner*—Michael N. Opsasnick
*Attorney, Agent, or Firm*—Beveridge, DeGrandi, Weilacher & Young, LLP

[57] ABSTRACT

A method and apparatus for synthesizing speech. According to one variation of the method and apparatus, a plurality of speech segment data units is prepared for all desired speech waveforms. Speech is then synthesized by reading out from memory the appropriate speech segment data units, and a desired pitch is obtained by overlapping the appropriate speech segment data units according to a pitch period interval. According to a second variation of the method and apparatus, speech segment data units are prepared for only initial speech waveforms and first pitch waveforms, and differential waveforms. With this variation, subsequent pitch waveforms for speech synthesis are generated by combining the first pitch waveform with the corresponding differential waveform. According to a third variation of the method and apparatus, a natural speech segment channel produces natural speech segment data units in the same manner as the first variation, and a synthesized speech segment channel produces speech segment data units according to a parameter method, such as a formant method. The natural speech segments and synthesized speech segments are then mixed to produce synthesized speech.

8 Claims, 28 Drawing Sheets

Fig. 3

| | |
|---|---|
| Syllable ID | |
| Phrase length | |
| Accent level | |
| Duration | |
| Start pitch | |
| Middle pitch | |
| | |

Fig. 4

Input: オ (ɔ) ン (ŋ) セ (se) エ (e) ／ ゴ (gɔ) 1 オ (ɔ) セ (se) エ (e)

| Symbol | オ | ン | セ | エ | ゴ | オ | セ | エ |
|---|---|---|---|---|---|---|---|---|
| Syllable ID | 4 | 47 | 15 | 3 | 52 | 4 | 15 | 3 |
| Phrase length | 4 | 0 | 0 | 0 | 4 | 0 | 0 | 0 |
| Accent level | 0 | 0 | 0 | 0 | 1 | 0 | 0 | 0 |

Fig. 5

Input : オ (ɔ) ン (ŋ) セ (se) エ (e) ／ ゴ (gɔ) 1 オ (ɔ) セ (se) エ (e)

| Symbol | オ | ン | セ | エ | ゴ | オ | セ | エ |
|---|---|---|---|---|---|---|---|---|
| Syllable ID | 4 | 47 | 15 | 3 | 52 | 4 | 15 | 3 |
| Phrase length | 4 | 0 | 0 | 0 | 4 | 0 | 0 | 0 |
| Accent level | 0 | 0 | 0 | 0 | 1 | 0 | 0 | 0 |
| Duration | 160 | 130 | 140 | 130 | 120 | 140 | 140 | 170 |
| Start pitch | 90 | 110 | 120 | 122 | 120 | 100 | 96 | 88 |
| Middle pitch | 100 | 116 | 121 | 121 | 110 | 98 | 92 | 86 |

Event type :

SC: segment change

TG: trigger others

Data :

SC:

Data 1: speech segment ID

No data 2 and later

TG:

Data 1: pitch ID

No data 2 and later

Fig. 8

| Event type | SC | TG | TG | TG | TG | TG | TG | TG | TG | TG | TG |
|---|---|---|---|---|---|---|---|---|---|---|---|
| Event interval | 0 | 830 | 109 | 106 | 103 | 101 | 99 | 97 | 95 | 93 | 92 |
| Data 1 | 4 | 0 | 1 | 2 | 3 | 4 | 4 | 5 | 6 | 6 | 7 |

Event interval is determined by length of initial waveform.

Fig. 13(a)
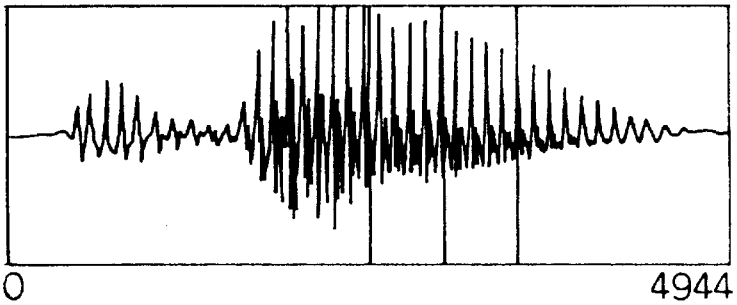
Fig. 13(b)
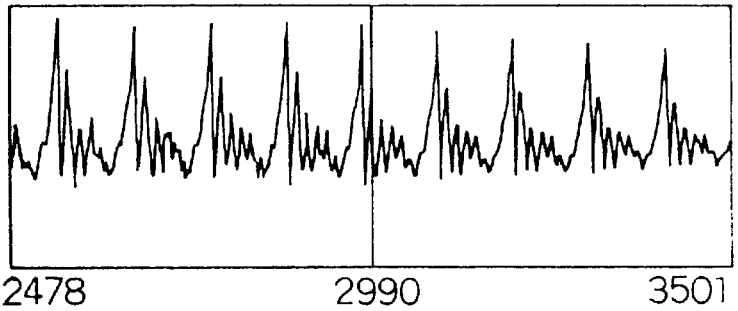
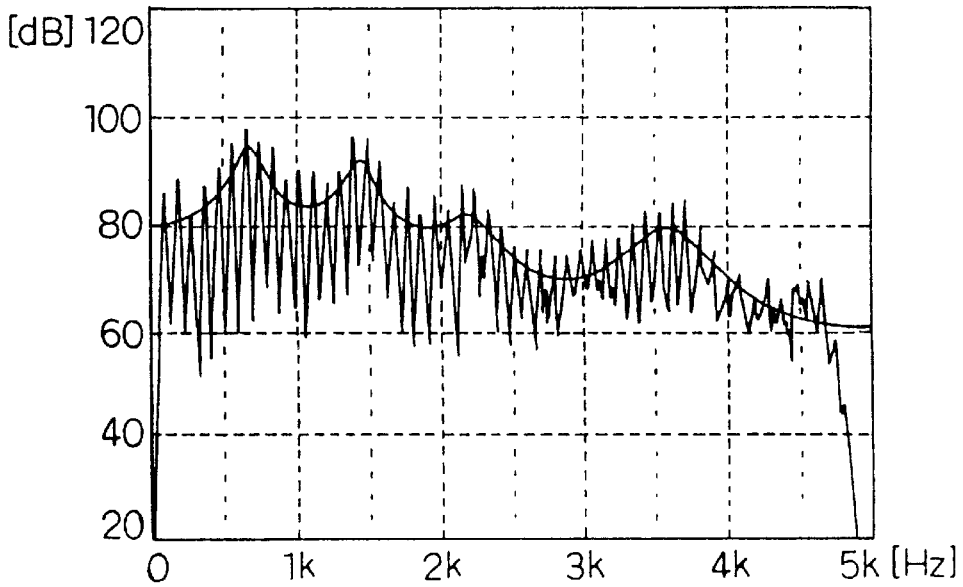
Fig. 13(c)

Fig. 14(a)
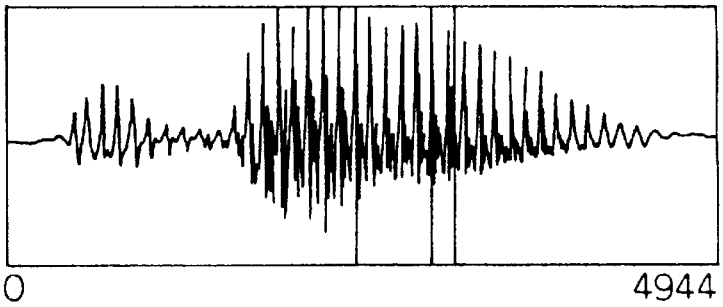
Fig. 14(b)
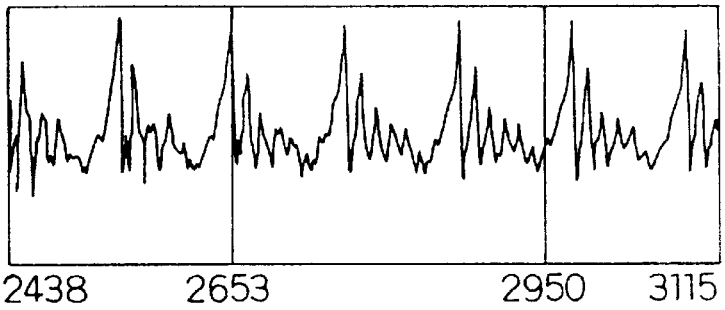
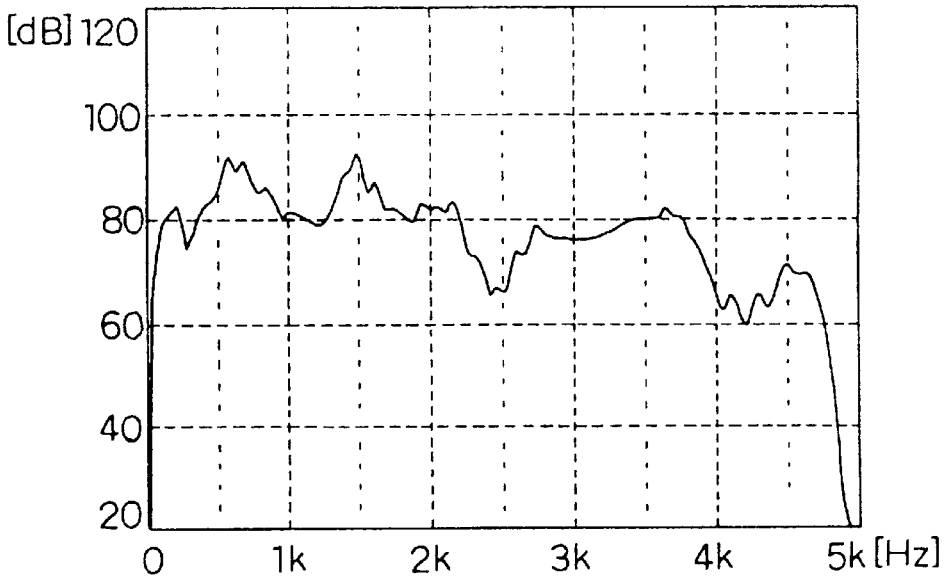
Fig. 14(c)

Fig. 15(a)
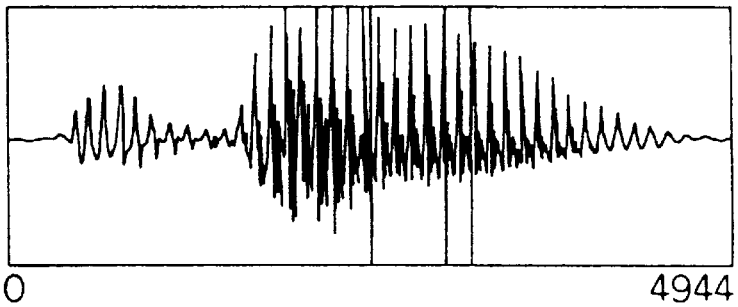
Fig. 15(b)
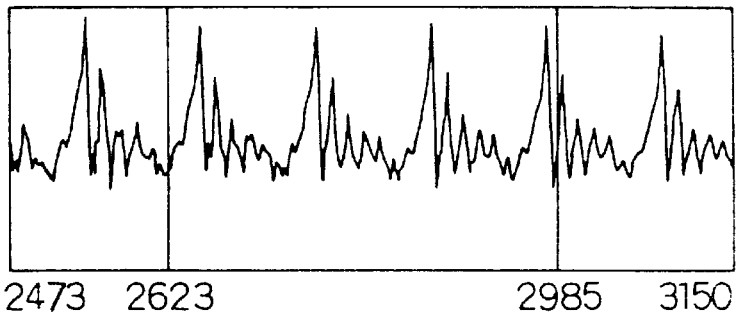
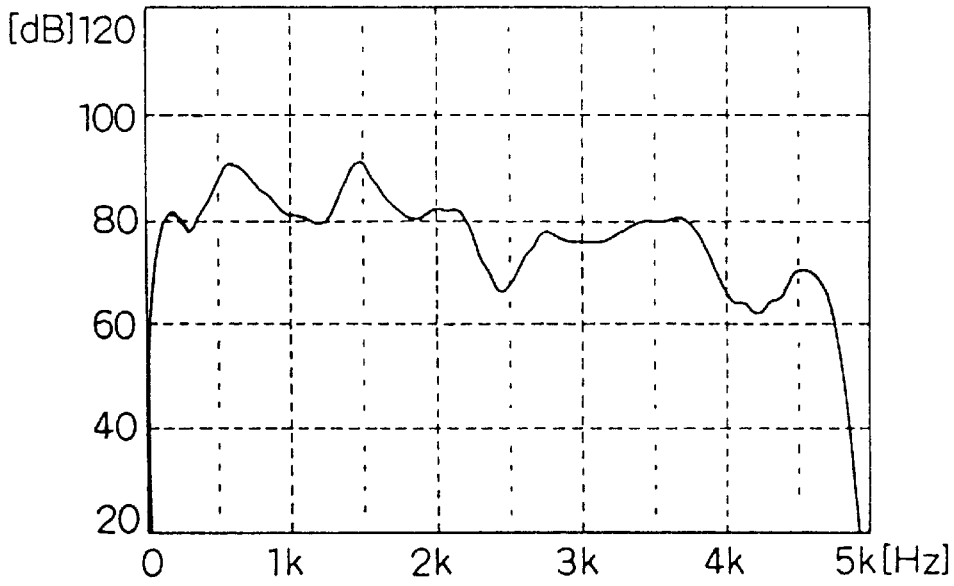
Fig. 15(c)

Fig. 19

| | Number of elements | Memory access | Trigonometric function calculation | Multiplication | Addition |
|---|---|---|---|---|---|
| Prior art | | 2 | 2 | 4 | 3 |
| First embodiment | n | n | 0 | 0 | n−1 |
| | 4 | 4 | 0 | 0 | 3 |
| Second embodiment | n | 3n | 0 | 0 | 2n−1 |
| | 4 | 12 | 0 | 0 | 7 |

Fig. 21

| Phoneme symbol row | ア | カ | イ | ハ | ナ |
|---|---|---|---|---|---|
| Phoneme information | /a/ | /ka/ | /i/ | /ha/ | /na/ |
| Time length (msec) | 60 | 192 | 40 | 155 | 127 |
| Start pitch (Hz) | 119 | 126 | 145 | 143 | 133 |
| Middle pitch (Hz) | 122 | 144 | 144 | 138 | 123 |

F1min: First formant frequency min.

F2min: Second formant frequency min.

F1max: First formant frequency max.

F2max: Second formant frequency max.

nF1idx: Number of classes of F1idx nF2idx: Number of classes of F2idx dF1: First formant frequency step width dF2: Second formant frequency step width F1idx: F1 index F2idx: F2 index

SPEECH SYNTHESIZING METHOD AND APPARATUS FOR COMBINING NATURAL SPEECH SEGMENTS AND SYNTHESIZED SPEECH SEGMENTS

BACKGROUND OF THE INVENTION

1. Field of the Invention

The present invention relates to a speech segment preparing method, speech synthesizing method, and apparatus thereof, applicable in telephone inquiry service, speech information guide system, speech rule synthesizing apparatus for personal computer, and the like.

2. Related Art of the Invention

A speech rule synthesizing technology for converting a text into speech can be utilized, for example, for hearing an explanation or an electronic mail while doing other task in a personal computer or the like, or hearing and proof-reading a manuscript written by a word processor. Moreover, by incorporating an interface using speech synthesis into a device such as electronic book, the text stored in a floppy disk, CD-ROM or the like can be read without using liquid crystal display or the like.

The speech synthesizing apparatus used for such purposes is required to be small and inexpensive. Hitherto, for such application, the parameter synthesizing method, compressed recording and reproducing method, and others have been used, but in the conventional speech synthesizing method, since special hardware such as DSP (digital signal processor) or memory of large capacity is used, applications for such uses have been rarely attempted.

To convert a text into speech, there are a method of making a rule of a chain of phonemes by a model, and synthesizing while varying the parameters by the rule according to an objective text, and a method of analyzing the speech in a small phoneme chain unit such as CV unit and VCV unit (C standing for a consonant, and V for a vowel), collecting all necessary phoneme chains from actual speech to stored as segments, and synthesizing by connecting the segments according to an objective text. Herein, the former is called the parameter synthesizing method, and the latter is the connection synthesizing method.

A representative parameter synthesizing method is the formant synthesizing method. This is a method of separating the speech forming process into a speech source model of vocal cord vibration and transmission function model of vocal tract, and synthesizing the desired speech by parameter time change of the two models. A representative parameter used in the formant synthesizing method is the peak position on the frequency axis of the speech vibration called formant. These parameters are generated by using the rule based on the phonetic findings, and the table storing the representative values of the parameters.

The parameter synthesizing method is high in the computational cost such as calculation of vocal tract transmission function, and the DSP or the like is indispensable for real-time synthesis. For parameter control, however, multitudinous rules are related, and the speech quality improvement is difficult. On the other hand, the table and rules are small in data quantity, and hence a small memory capacity is sufficient.

By contrast, the connection synthesizing method is available in the following two types depending on the format of memory of segments. That is, the parameter connection method of converting the segments into PARCOR coefficients or LSP parameters by using the speech model, and the waveform connection method of accumulating the speech waveforms directly without using speech model are known.

In the parameter connection method, the speech is segmented in small units of CV syllable, CVC, VCV (C standing for a consonant, and V for a vowel), etc., and converted into parameters such as PARCOR coefficients to be accumulated in the memory, and is reproduced as required, in which the memory format is the speech parameter, and therefore the pitch or time length can be changed easily when synthesizing, so that the segments can be connected smoothly. Besides, the required memory capacity is relatively small. A shortcoming is, however, that the calculation processing amount for synthesizing is relatively large. It, hence, requires an exclusive hardware such as DSP (digital signal processor). Yet, since the speech modeling is not sufficient, there is a limit in the sound quality of the speech reproduced from the parameters.

As the waveform connection method, on the other hand, the method of accumulating the speech directly in the memory, and the method of compressing and coding the speech to be accumulated in the memory, and reproducing when necessary are known, among others, and for compressive coding, $\mu$-Law coding, ADPCM, and others are used, and it is possible to synthesize the speech at higher fidelity than in the parameter connection method.

When the contents of the speech to be synthesized are limited to few variety, it may be recorded in the sentence unit, syllable unit, or word unit, and edited properly. For synthesizing an arbitrary text, however, it is required to accumulate in further small speech segments, same as in the parameter connection method. Different from the parameter synthesis, it is difficult to change the pitch or time length, and therefore for synthesis of high quality, segments having various pitches and time lengths must be prepared.

Hence, the memory capacity of each segment is more than ten times that of the parameter connection method, and a further larger memory capacity is needed if a high quality is desired. Factors for increasing the memory capacity are dominated by the complicatedness of the phoneme chain units used in segments, and the preparation of segments in consideration of variation of pitch and time length.

As the phoneme chain unit, as mentioned above, the CV unit or VCV unit may be considered. The CV unit is a unit of combination of a pair of consonant and vowel corresponding to one syllable of the Japanese language. The CV unit is available in 130 types of combination, assuming 26 consonants and 5 vowels. In the connection of CV units, since a continuous waveform change from a preceding vowel to a consonant cannot be expressed, the naturalness is sacrificed. It is the VCV unit that is a unit including a preceding vowel of a CV unit. Hence, the VCV unit is available in 650 types, five times more than in the CV unit.

Concerning the pitch and time length, in the waveform connection method, different from the parameter connection method, it is difficult to change the pitch and time length of segments once prepared. Accordingly, segments must be prepared including variations, from the speech uttered at various pitches and time lengths beforehand, which gives rise to increase of the memory capacity.

Thus, a large memory capacity is required for synthesizing speech at high quality by the waveform connection method, and a large memory capacity several times to scores of times more than in the parameter synthesizing method is needed. In principle, however, a speech of an extremely high quality can be synthesized by using a memory device of a large capacity.

Therefore, the waveform connection method is superior in speech synthesizing method of high quality, but the problems are that the intrinsic pitch and time length of speech segment cannot be controlled, and that a memory device of large capacity is needed.

To solve these problems, a PSOLA (Pitch Synchronous Overlap Add) method is proposed (Japanese Patent Publication No. 3-501896), in which the speech waveform is cut out at window function in synchronism with the pitch, and overlapped to a desired pitch period when synthesizing.

The cut-out position in this method has the peak of the excitation pulse by closure of the glottis in the center of the window function. The shape of the window function should attenuate to 0 at both ends (for example, Hanning window). The window length is twice as long as the synthesized pitch period when the synthesized pitch period is shorter than the original pitch period of the speech waveform, and twice the original pitch period, to the contrary, when the synthesized pitch period is longer. The time length can be also controlled by decimating or repeating the cut-out pitch waveform.

As a result, from one speech segment, a waveform of arbitrary pitch and time length can be synthesized, so that a synthesized sound of high quality can be obtained by a small memory capacity.

In this method, however, the problem is that the quantity of calculation is large when synthesizing the speech. It is because it is necessary to cut out the pitch waveform by using window function when synthesizing, and calculation of trigonometric function and multiplication are performed frequently.

For example, operations necessary for synthesizing one sample of waveform include the follows. To generate one sample of pitch waveform, the memory is read out once for reading out the speech segment, the calculation of trigonometric function necessary for calculation of the Hanning window function is once and the addition is once (for giving a direct-current offset to the trigonometric function), the multiplication for calculating the angle to be given to the trigonometric function is once, and the multiplication for applying window to the speech waveform by using the value of trigonometric function is once. Since a synthesized waveform is produced by overlapping two pitch waveforms, one sample of synthesized waveform requires two times of memory access, two times of calculation of trigonometric function, four times of multiplication, and three times of addition (see FIG. 19).

Incidentally, to prevent increase of phoneme chain unit, a hybrid method is proposed (Japanese Patent Application No. 6-050890). In this method, basically, segments are composed of CV units only, and the waveform varying portion from vowel to consonant is generated by parameter synthesizing method. Therefore, the variety of phoneme chain unit is about 130 types, and the operation rate of the parameter synthesizing portion can be lowered, so that the calculation cost can be suppressed low as compared with the pure parameter synthesizing method.

In the hybrid method, however, the calculation cost of the parameter synthesizing portion is high. Furthermore, in the case of real-time parameter synthesis or high changing speed of the parameters, harmful noise may be caused due to effects of calculation precision or transient characteristic effect of synthesis transmission function (so-called filter). Accordingly, plopping, cracking or other unusual sound may be generated in the midst of synthesized sound, and the sound quality deteriorates.

SUMMARY OF THE INVENTION

In the light of the problems in the conventional speech synthesis, it is hence a primary object of the invention to present a speech segment preparing method, speech synthesizing method, and apparatus for use therein, small in deterioration of sound quality, and capable of decreasing the calculation quantity when synthesizing the speech.

According to the invention, in each peak existing in every pitch period within a specific interval of speech waveform, the pitch waveform is cut out by a window function of a length shorter than reaching the both adjacent peaks in every peak, speech segment data is prepared for all desired speech waveforms on the basis of the speech waveform, the speech segment data is stored, a desired pitch waveform of desired speech segment data is read out from the stored speech segment data, and arranged by overlapping to a desired pitch period interval, and they are summed up and produced as one speech waveform.

The invention also presents a speech synthesizing method for generating a control signal row as a train of control signals having time information, function information expressing specific functions, and an arbitrary number of parameters corresponding to the specific functions, and controlling the speech segments along the timing expressed by the time information, by using the function information and parameters of control signals.

The invention further presents a speech synthesizing apparatus comprising control means for generating a control signal row as a train of control signals having time information, function information expressing specific functions, and an arbitrary number of parameters corresponding to the specific functions, and controlling the speech segments along the timing expressed by the time information, by using the function information and parameters of control signals.

In the invention, the waveform changing portion from vowel to consonant hitherto done by parameter synthesis is replaced by a special connection synthesis. As its means, segments to be used in generation of waveform changing portion are preliminarily synthesized by parameter synthesis. As a result, the calculation cost in the waveform changing portion from consonant to vowel corresponding to the conventional parameter synthesizing portion is nearly same as in other connection synthesizing portions, and synthesis is realized at a lower calculation capacity than in the prior art, and moreover the capacity of the buffer memory for absorbing fluctuations of calculation speed can be also decreased. Furthermore, since the segments used in waveform changing portion are synthesized by using stationary parameters preliminarily, the unusual sound which is a problem in synthesis while varying the parameters does not occur theoretically.

As clear from the description herein, it is an advantage of the invention that the calculation quantity when synthesizing speech can be decreased without deteriorating the sound quality.

It is other benefit that the required memory capacity can be decreased by compressing the speech segments by calculating the difference of the pitch waveform.

According to the invention, the calculation cost in the waveform changing portion from consonant to vowel corresponding to the parameter synthesizing portion in the prior art is similar to that in the other connection synthesizing portions, so that the entire calculation cost can be suppressed extremely low.

Besides, the capacity of the buffer memory hitherto required for absorbing the fluctuations of calculation speed can be reduced.

In addition, the problem of unusual sound generated in parameter synthesis can be eliminated theoretically.

BRIEF DESCRIPTION OF THE DRAWINGS

FIG. 3 is a diagram showing data structure of syllable buffer in the first embodiment.

FIG. 4 is a diagram explaining the mode of setting of syllable ID, phrase length, and accent level in a syllable buffer in the first embodiment.

FIG. 5 is a diagram explaining the mode of setting prosodics in a syllable buffer in the first embodiment.

FIG. 8 is a diagram explaining the mode of generating an event list to a syllable "さ" in the first embodiment.

FIGS. 13(*a*)–13(*c*) are diagrams showing a spectrum of original speech waveform.

FIGS. 14(*a*)–14(*c*) are diagrams; showing a spectrum when the window length is 2 times the pitch period.

FIGS. 15(*a*)–15(*c*) are diagrams showing a spectrum when the window length is 1.4 times the pitch period.

FIG. 19 is a diagram showing comparison of calculation quantities.

FIG. 21 is a block diagram of information outputted from a phoneme symbol row analysis unit 1 into a control unit 2 in the third embodiment.

[Reference Numerals]

Control unit

Figure 1:
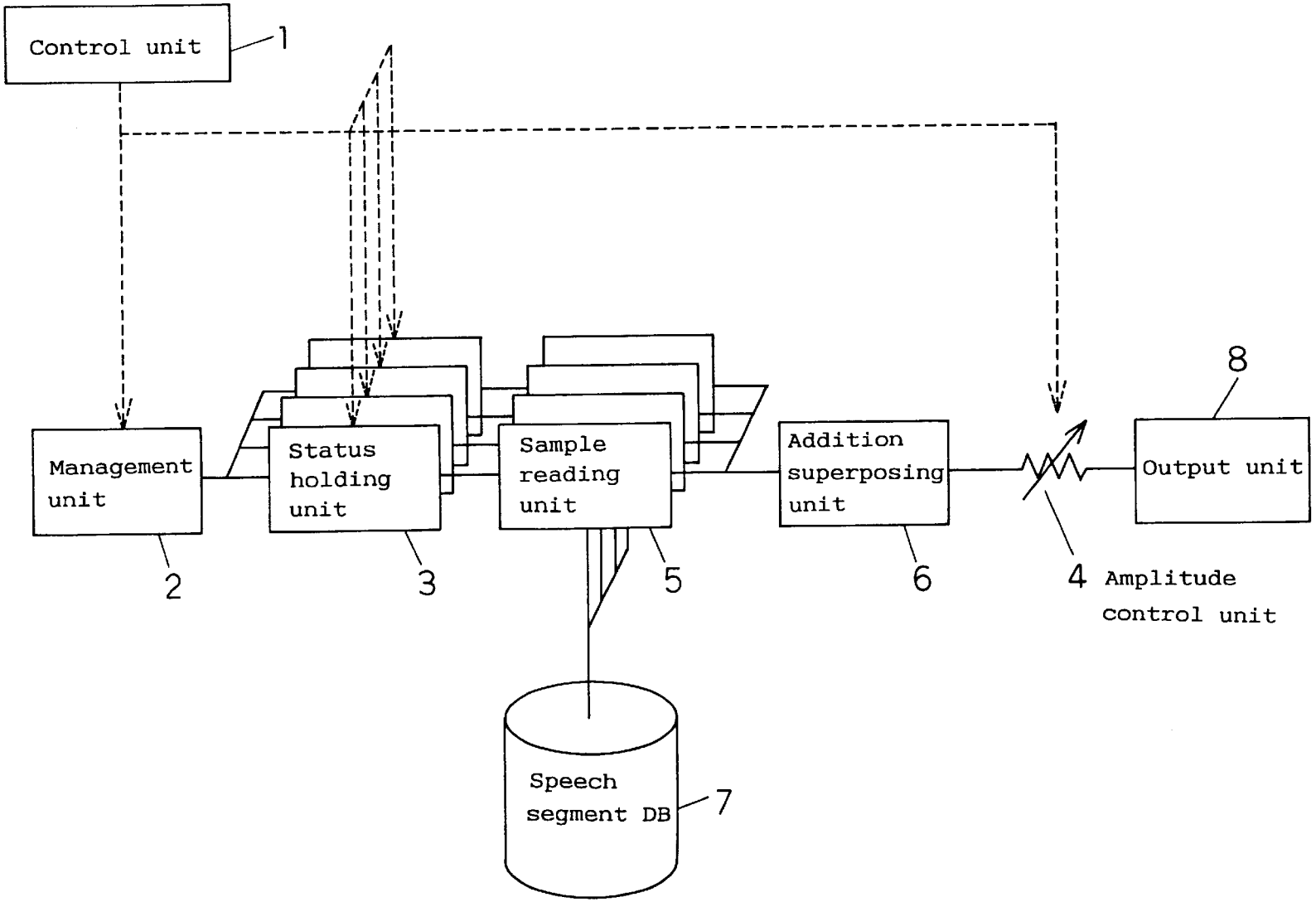
FIG. 1 is a block diagram of a speech synthesizing apparatus in a first embodiment of the invention.

1 Management unit
2 Status holding unit
3 Amplitude control unit
4 Sample read unit
5 Addition superposing unit
6 Speech segment DB
7 Output unit
8 Waveform holding unit
9 Compressed speech segment DB
10 Phoneme symbol row analysis unit
101 Control unit
103, 105, 113, 115 Speech segment reading units
104, 106, 114, 116 Speech segment DB
107, 117 Mixing units
108 Amplitude control unit
109 Output unit
110 Individual information DB
111 Synthesized speech segment channel
112 Natural speech segment channel

PREFERRED EMBODIMENTS OF THE INVENTION

Referring now to the drawings, preferred embodiments of the invention are described in detail below.

FIG. 1 is a block diagram of a speech synthesizing apparatus in a first embodiment of the invention. That is, in this speech synthesizing apparatus, a control unit 1 is provided as control means, and its output is connected to a management unit 2 as management means, plural status holding units 3, and an amplitude control unit 4. The management unit 2 is connected to the plural status holding units 3, and these plural status holding units 3 are connected one by one to plural sample reading units 5 which are pitch waveform reading units. The outputs of the plural sample reading units 5 are connected to the input of an addition superposing unit 6, and the output of the addition superposing unit 6 is connected to the amplitude control unit 4. The output of the amplitude control unit 4 is connected to an output unit 8, and an electric signal is converted into an acoustic vibration, and is outputted as sound. A speech segment DB 7, speech segment data memory means, is connected to the plural sample reading units 5.

Figure 2:
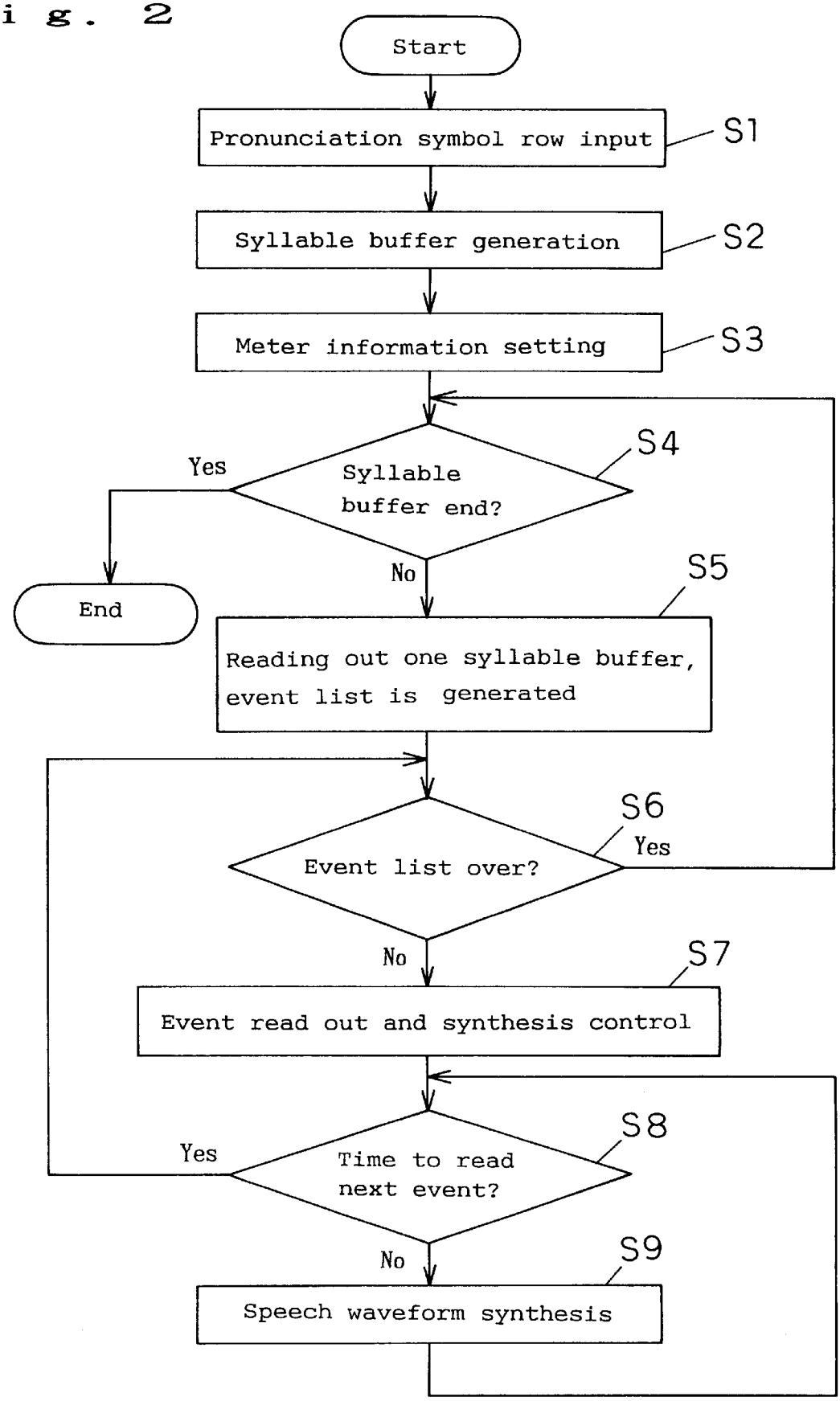
FIG. 2 is a flowchart of entire processing, mainly about the control unit, in the first embodiment.

In thus constituted speech synthesizing apparatus, the operation is described below while referring to a flowchart. FIG. 2 is a flowchart showing the flow of entire processing, mainly about the control unit 1.

First of all, the control unit 1 receives a pronunciation symbol such as Roman alphabet notation or katakana combined with accent and division information as input data (step S1). It is then analyzed, and the result is stored in the buffer in every syllable (step S2). FIG. 3 shows the data structure of a syllable buffer. Each syllable has data fields for syllable ID, phrase length, accent level, duration, start pitch, central pitch, etc., and it is arranged to have a length enough for storing the number of syllables to be inputted at once (for example, a portion of a line).

The control unit 1 analyzes the input data, and sets the syllable ID, phrase length, and accent level. The syllable ID is the number for specifying the syllable such as 'あ' and 'か'. The phrase length is a numerical value showing the number of syllables in a range enclosed by division symbol of the input, and the numerical value is set in the field of the syllable starting a phrase. The accent level means the strength of accent, and each phrase has either 0 or 1 accent level.

For example, by input of a symbol row of 'オ(o) ン(se)(n) セ(e) エ/ゴ(go) 1 オ(o) セ(se) エ(e)' (/ is division symbol, and 1 is accent level) as a result of linguistic processing of the term '音声合成', the mode of setting of syllable ID, phra length, and accent level is shown in FIG. 4. The phrase length is set in the beginning syllable of a phrase.

Consequently, on the basis of the information of thus set phrase length and accent level, prosodics is set (step S3). Setting of prosodics is divided into setting of duration (herein the syllable duration time) and setting of pitch. The duration is determined by the predetermined speech speed, and the regulations in consideration of the relation before and after syllable and others. The pitch is generated by a pitch generating method such as Fujisaki model, and is expressed by the values at the beginning and middle of a syllable. The mode of setting of prosodics in the input symbol row of 'オ ン セ エ/ゴ1 オ セ エ' of the above example is shown in FIG. 5

Figure 6:
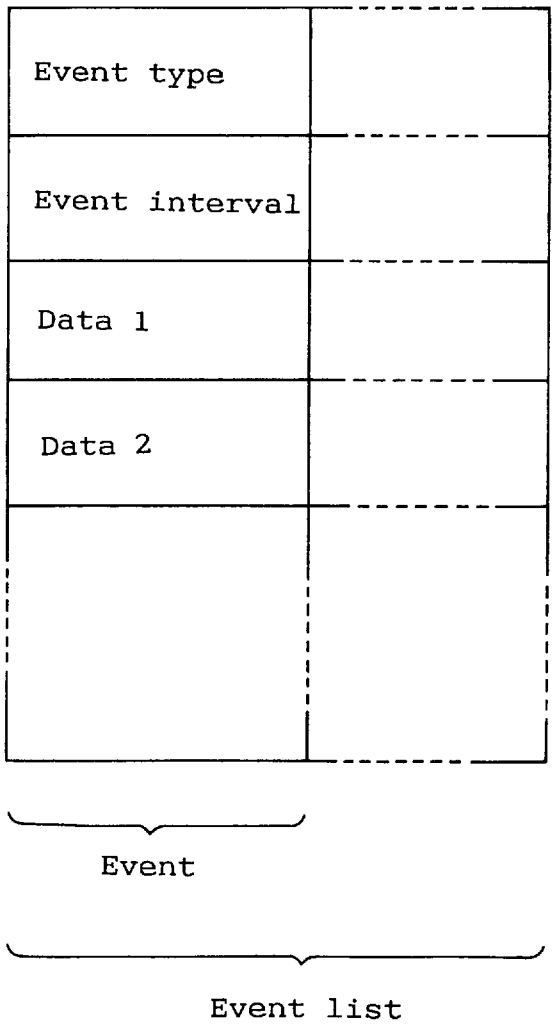
FIG. 6 is a diagram showing data structure of event list in the first embodiment.

Thus generated syllable buffers are read out one by one sequentially, and an event list is generated (step S5). If no syllable buffer is left over (step S4), the processing is over. The event list is an array of information called events providing functional information for directly giving instructions to the speech waveform synthesizing unit, and is structured as shown in FIG. 6. Each event has an "event interval" as the spacing to the next event as time information, and hence the event list function as control information along the time axis.

Types of event include SC (Segment Change) and TG (Trigger). The SC is an instruction to change the speech segment into one corresponding to the syllable type indicated by the syllable ID.

Data is provided depending on each event type. SC has speech segment ID as parameter, and TG has pitch ID as data. The speech segment ID is the number indicating the speech segment corresponding to each syllable, and the pitch ID is the number indicating the waveform (pitch waveform) being cut out in every pitch period in each speech segment.

When one syllable buffer is read out, the syllable ID is referred to, and the corresponding speech segment ID is set in the data, and the SC event is generated. The event interval may be 0.

Next, the TG event is generated. Beforehand, the data structure of the speech segment stored in the speech segment DG 7 is described below.

Figure 7:
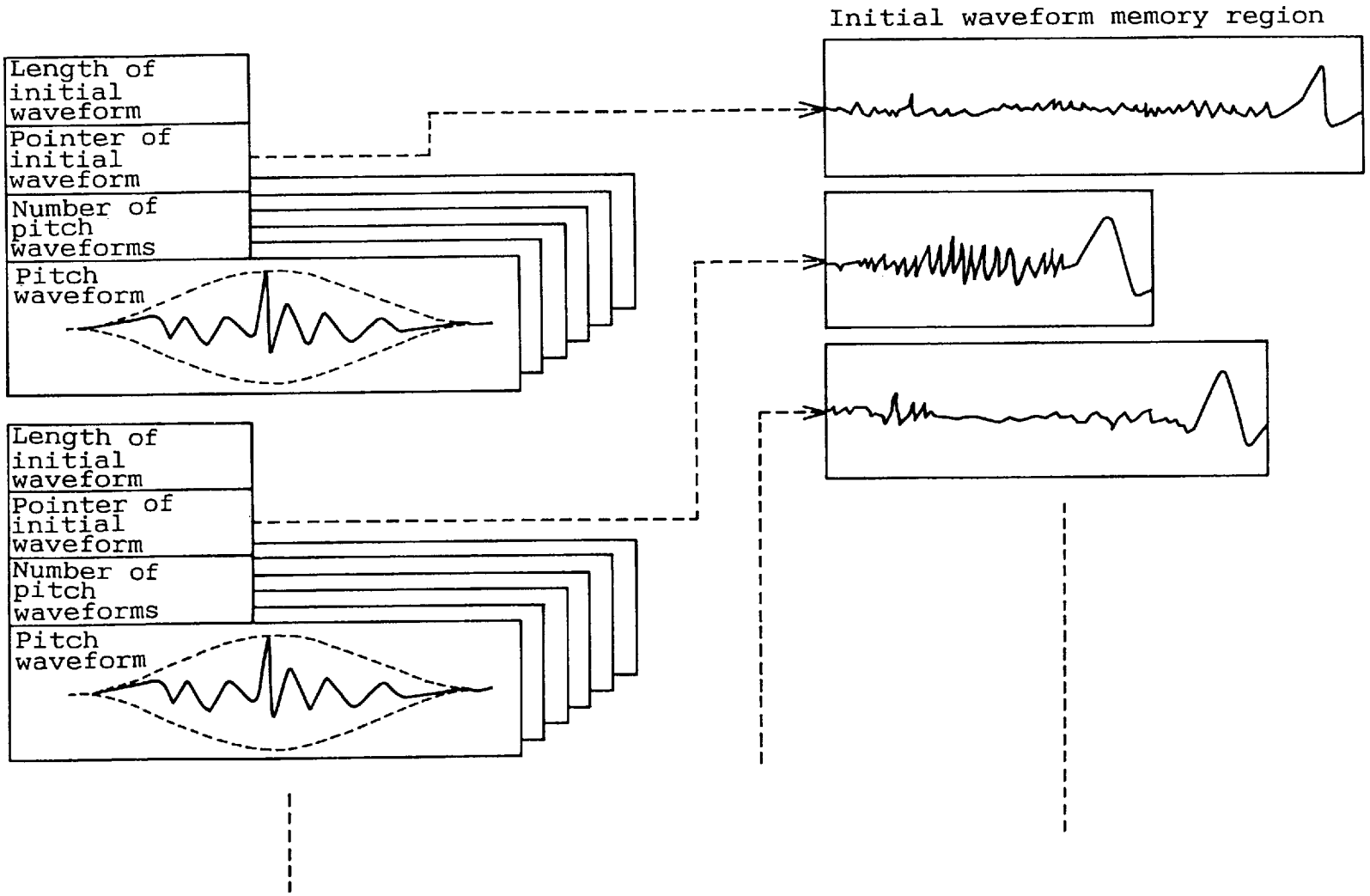
FIG. 7 is a diagram showing data structure of speech segment in speech segment DB in the first embodiment.

FIG. 7 is an explanatory diagram of data structure of speech segment. A speech segment is divided into one initial waveform and plural pitch waveforms. For example, at the beginning of a syllable 'カ', there is a voiceless section without vocal cord vibration and without pitch. This part is a tuning part of the consonant 'k'. In such place, it is not necessary to control the pitch when synthesizing, and it is held directly as waveform. This is called initial waveform.

Such initial waveform is used not only in voiceless consonant such as k, s, t, but also in voiced consonant such as g, z, d. In the case of 'z', for example, since the noise property is strong, and the pitch is unstable at the beginning also in other voiced consonants, and hence it is hard to cut out the pitch waveform. Accordingly, the beginning short section is cut out as initial waveform.

When the section of 'k' is over, vibration of the vocal cord starts to get into the voiced sound section. In such section, by cutting out with Hanning window, centered around the peak of the waveform corresponding to the pitch period, it is separated and held in each pitch period. This is called pitch waveform.

The data of each speech segment is a structure consisting of "length of initial waveform," "pointer of initial waveform," "number of pitch waveforms," and plural "pitch waveforms." The size of pitch waveform should be large enough for accommodating the windowlength of the Hanning window mentioned above. As described later, the window length is a value smaller than two times the pitch period, and the manner of determining its size is not required to be precise. It may be set uniform in all pitch waveforms in all speech segments, or a different value may be set in each speech segment, or a different value may be set in each pitch waveform. In any method, fluctuations of window length are small. Therefore, the two-dimensional layout gathering plural pitch waveforms contributes to effective use of the memory region.

An array of such structure is formed, and speech segments of all necessary speeches (syllables) are accumulated. Initial waveforms are separately stored in a different region. Since the initial waveforms are not uniform in length depending on speech segments, and when contained in the structure of speech segments, it is a waste of memory capacity, and hence they may be preferably stored in a different continuous region in one-dimensional layout.

Assuming such speech segments are prepared, the explanation goes back to generation of TG event.

In the data of TG event, pitch ID is set. In the first TG event data, 0 is set to show initial waveform. The event interval is the "initial waveform length" minus ½ of the window length.

In succession, a TG event is generated. In the data of this TG event, 1 is set to show the first pitch waveform. The event interval is the pitch period at the position where the pitch waveform is used for synthesis. The pitch period is determined by interpolation from the pitch information of the syllable buffer (starting pitch and central pitch).

Similarly, TG events are generated for the portion of one syllable. The pitch ID which is the data of each TG event is selected so that the position of the pitch waveform in the original speech waveform and the position in the syllable in synthesis may be at the shortest distance. That is, when the pitch of the original speech waveform and the pitch of synthesis are identical, the pitch ID increases one by one, 0, 1, 2, and so forth, but when the pitch in synthesis is higher, same number is repeated several times, like 0, 1, 1, 2, 3, 3, and so forth. To the contrary, when the pitch in synthesis is lower, it goes like 0, 1, 3, 4, 6, and so forth, and intermediate numbers are skipped. In this way, it is designed to prevent change of the time length of the speech segment by pitch control in synthesis. FIG. 8 shows the mode of creation of event list for the syllable 'オ'.

Figure 9:
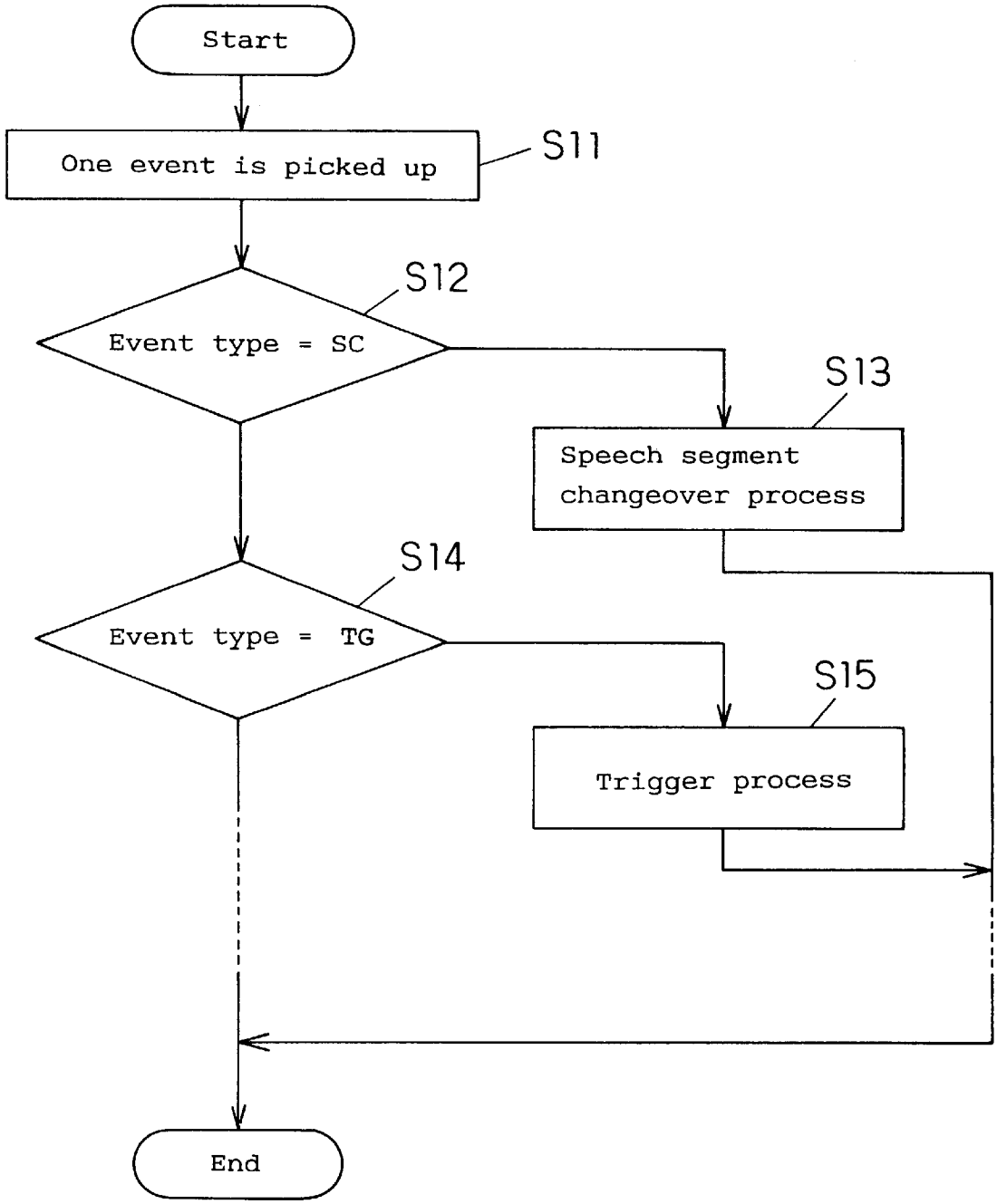
FIG. 9 is a flowchart of the unit for event reading and synthesis control in the first embodiment.

When the event list for one syllable is created, going to next step, event reading and synthesis control are processed (step S7). This process is specifically explained in the flowchart in FIG. 9. In FIG. 9, picking up one event (step S11), it is judged whether the event type is SC or not (step S12), and if SC, the speech segment change process is executed (step S13), and if not SC, it is judged whether the event type is TG or not (step S14), and if TG, the trigger process is executed (step S15). Afterwards, it is judged whether it is time to read the next event or not (step S8), and the process of speech waveform synthesis is repeated until the time comes (step S9), and further the process from event reading to speech waveform synthesis is repeated until the event list is over.

Figure 10:
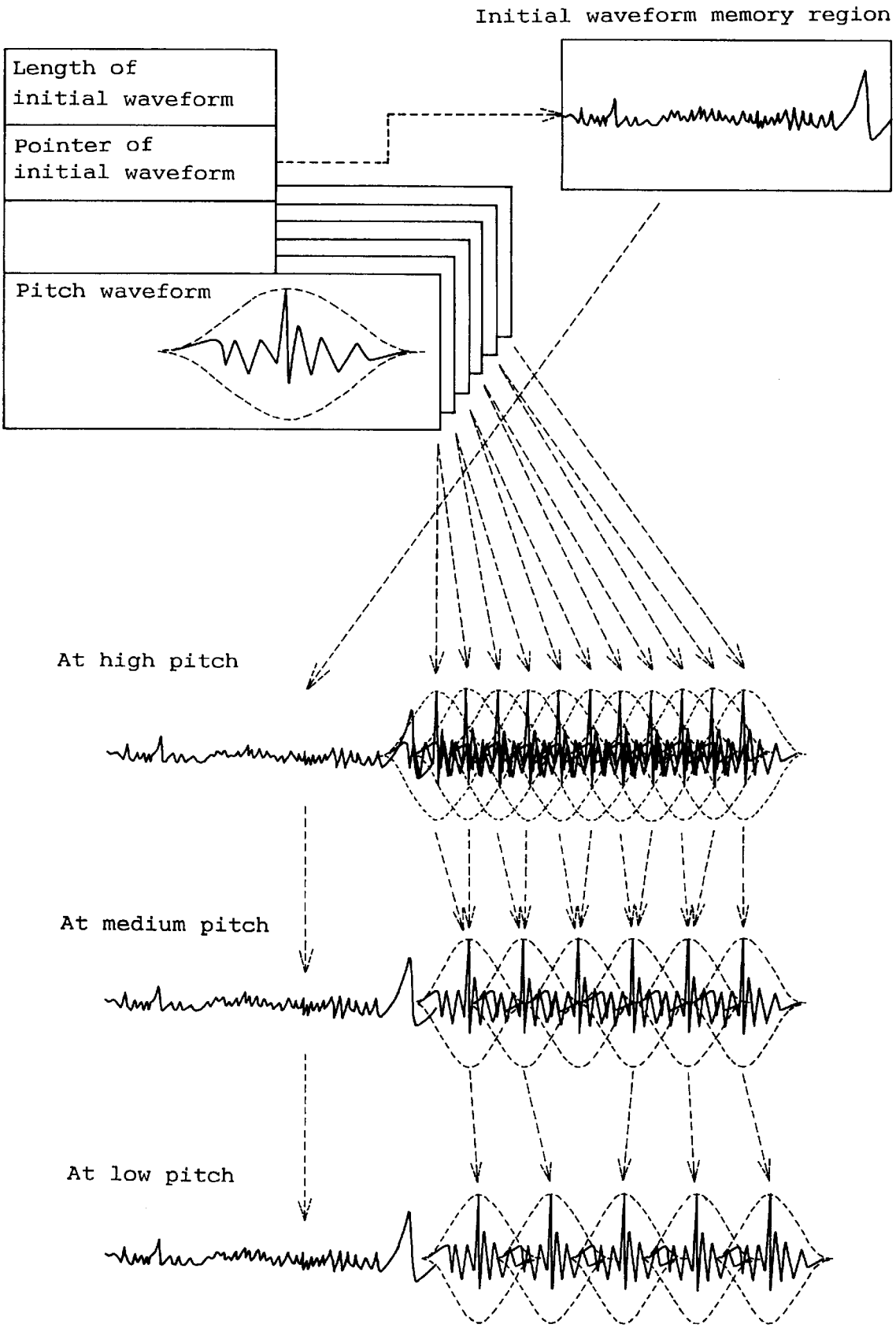
FIG. 10 is a diagram explaining the mode of synthesizing speech having a desired pitch in the first embodiment.

The speech segment change process and trigger process in FIG. 9 are explained later. These processes are done on the basis of the time information, such as control of pitch, because it is done according to the event interval each event possesses. That is, when a certain event is read out, if the event interval is 20, the next process of speech waveform synthesis is executed 20 times, and then the next event is read out. In the speech waveform synthesis process, speech waveform of one sample is synthesized. Since the event interval of TG event is a pitch period, by reading out the pitch waveform according to the TG event, the speech waveform having the intended pitch period is synthesized. The mode of synthesis of speech having the desired pitch is shown in FIG. 10.

The detail of speech waveform synthesizing process is described below. The management unit 2 manages the speech segment ID, and also manages the element ID expressing which element is to be used next among the combinations (called elements) of the plural status holding units 3 and sample reading units 5. The status holding unit 3 of each element holds the present pitch ID, beginning address and end address of pitch waveform, and read address expressing the address being read out at the present. The sample reading unit 5 picks up a read address from the status holding unit 3, and when it is not beyond the end address, it reads out one sample of speech segment from the corresponding address of the speech segment DB 7. Afterwards, the read address of the status holding unit 3 is added by one. The addition superposing unit 6 adds and outputs the outputs the sample reading units 5 of all elements. This output is controlled of the amplitude by the amplitude control unit 4, and converted into acoustic vibration by the output unit 8 to be outputted as speech.

In the speech segment change processing in FIG. 9, the speech segment ID of the management unit 2 is converted to the one corresponding to the given syllable ID.

Figure 11:
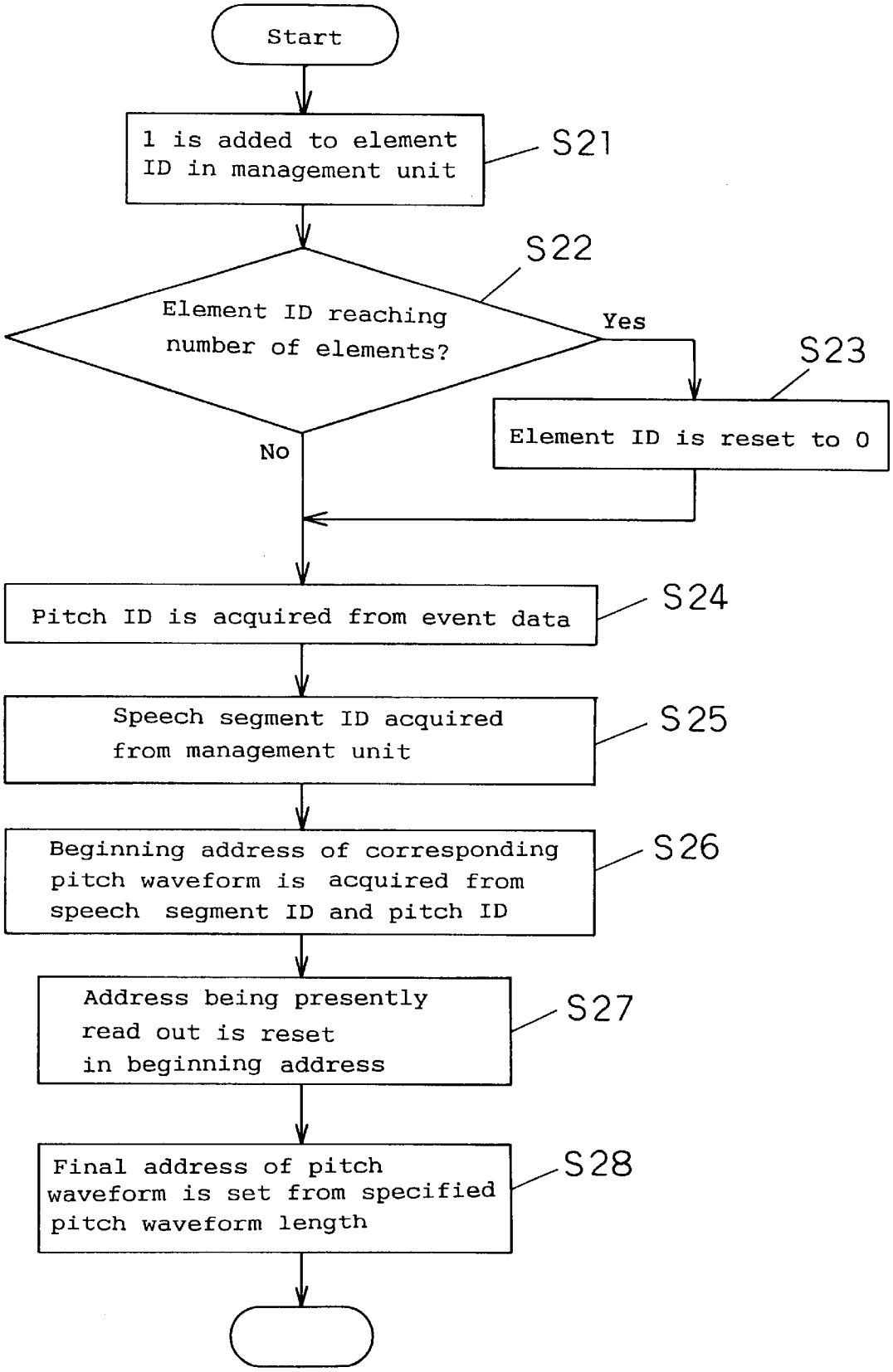
FIG. 11 is a flowchart of trigger processing in the first embodiment.

In trigger process, the element ID of the management unit 2 is updated cyclically. That is, as shown in FIG. 11, first 1 is added to the element ID (step S21), and it is judged whether it has reached the number of elements or not (step S22), and it is reset to 0 if reaching (step S23). In consequence, the pitch ID is picked up from the event data (step S24), and further the speech segment ID is taken out from the management unit 2 (step S25), the beginning address of the corresponding pitch waveform of the corresponding speech segment is acquired (step S26), and it is set in the beginning address of the status holding unit 3. Moreover, the read address is initialized by the pitch waveform beginning address (step S27), and the final address is set by using the length of the predetermined pitch waveform (step S28).

Figure 12:
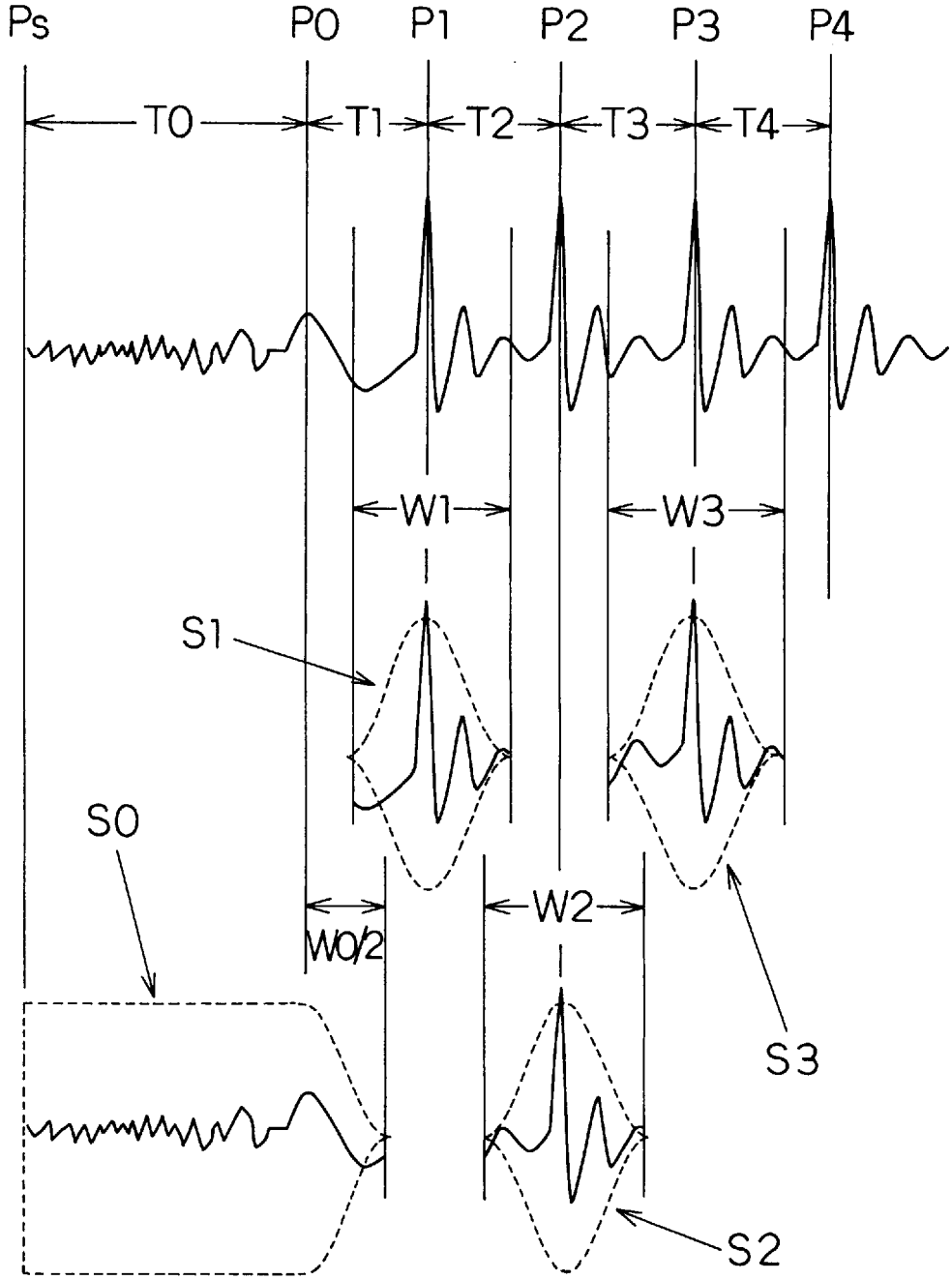
FIG. 12 is a diagram explaining the mode of creating speech segment from speech waveform in the first embodiment.

FIG. 12 shows a method of preparing speech segments in this embodiment. In the diagram, the top figure shows the speech waveform which is the basis of speech segment. Ps denotes a start mark, P0, P1, . . . are pitch marks attached to peaks corresponding to pitches, and W0, W1, . . . indicate the cut-out window lengths. S0, S1, . . . are cut-out waveforms. S1 and the following show pitch waveforms being cut out in every pitch period, while S0 is an initial waveform, which is a waveform being cut out from the start mark to P0 and to the length of W0/2 thereafter. After P0 is shown the latter half of Hanning window, and before it is a square window. Segments after S1 are cut out by the Hanning window.

The Hanning window length Wn (n=0, 1, 2, . . . ) may be determined uniformly, for example as shown in formula 1, by using a representative value (such as mean) of the pitch period for all speech waveforms,

[1] $Wn=T_{all}\times R$ ($T_{all}$ is mean of pitch period of all speech) or, as shown in formula 2, it may be determined by using a representative value (such as mean) of pitch period in each speech waveform,

[2] $Wn=T_{ind}\times R$ ($T_{ind}$ is mean of pitch period of individual speech) or, as in formula 3 or 4, it may be determined individually from the adjacent pitch period in each pitch waveform.

[3] $Wn=((T_n+T_{n+1})/2)\times R$, for $n\geqq 1$

[4] $WO=T_1\times R$ where R is the ratio of window length to the pitch period, and it is, for example, about 1.4. This reason is explained below. FIGS. 13(*a*)–13(*c*) show time waveform of certain speech (FIG. 13(*a*)), and its FFT spectrum (FIG. 13(*b*)) and LPC spectrum envelope (FIG. 13(*c*)). The sampling frequency fs is as shown in formula 5,

[5] fs=10 kHz

The analysis window length W is as shown in formula 6,

[6] w=512

The linear predict order M is as shown in formula 7.

[7] M=12

The window function is Hanning window. The pitch period T of this speech is as shown in formula 8, and the analysis objective section is from point 2478 to point 2990 of time waveform.

[8] T=108

The FFT spectrum is a higher harmonic, and hence has a comb-shaped period structure, which is sensed as a pitch. The LPC spectrum envelope has a smooth shape like linking the peaks of FFT spectrum, and the phoneme is sensed by this shape.

FIGS. 14(*a*)–14(*c*) show the time waveform of the same speech (FIG. 14(*a*)), and the FFT spectrum at W=2T (the window links 2 times the pitch) (FIG. 14(*b*)). The section from point 2438 to point 2653 of the time waveform is the analysis objective section. At this time, the FFT spectrum loses its comb-shaped structure, and a spectrum envelope is expressed. This is because the frequency characteristic of the Hanning window is convoluted into the original spectrum.

That is, the original spectrum shown in FIGS. 13(*a*)–13(*c*) has a comb-shaped period structure at interval of fs/T. On the other hand, in the frequency characteristic of the Hanning window of the window length W, the bandwidth B of the main lobe is as shown in formula 9.

[9] B=2fs/W

At W=2T, B is as shown in formula 10, and by convoluting it together with the speech spectrum, it is effective to fill up the gap of higher harmonics.

[10] B=fs/T

Because of this reason, the pitch waveform being cut out by the Hanning window at W=2T has a spectrum close to the spectrum envelope of the original speech. By rearranging and superposing thus cut-out waveform by a new pitch period T', speech of desired pitch period can be synthesized.

If W<2T, it follows that B>fs/T, and hence the spectrum envelope is distorted when convoluted together with the speech spectrum. If W>2T, it follows that B<fs/T, and when convoluted together with speech spectrum, it is not sufficiently effective to fill up the gap of higher harmonics, and its spectrum contains the harmonic structure of the original speech. In such a case, if rearranged and superposed in the intended pitch period, an echo-like sound is generated because the information of the pitch having the original speech waveform is left over.

By making use of the above property, the prior art (V/Japanese Patent Publication (Toku-hyou-hei) No. Heisei 3-501896) has realized pitch change of high quality by defining W=2T when the relation of the pitch period T of the original speech and intended pitch period T' is T<T', and W=2T' when T>T'. When T>T', that is, when raising the pitch, the window length 2 times the synthesized pitch period is used instead of the pitch period of the original speech, which is because the power of the synthesized waveform is kept uniform. That is, the sum of two Hanning window values is always 1, and power change does not occur.

When W<2T, as mentioned above, the cut-out pitch waveform contains distortion from the original speech spectrum. This distortion, however, may be permitted unless W is extremely small as compared with 2T. If the range of all synthesis pitches can be covered by a fixed W, only by preparing speech segments having window beforehand, without having to cutting out window at the time of synthesis as in the prior art, only overlapping process of pitch waveforms is required at the time of synthesis, and hence the quantity of calculation can be reduced.

When using a fixed W, the power varies depending on the change of synthesis pitch. That is, the power of synthesized waveform is proportional to the synthesized pitch frequency. Such power change is, fortunately, approximate to the relation of pitch and power of natural speech. In natural speech, such relation is observed, that is, when the pitch is high, the power is large, or when the pitch is low, the power is small. Thus, by using a fixed W, a synthesized sound is obtained in a property closer to the natural speed.

Assuming W=2T, accordingly, the cut-out pitch waveform does not have harmonic structure on its spectrum, and pitch change of high quality is expected.

Referring back to FIG. 14, although the harmonic structure is nearly removed, it is slightly left over. The reason is that the bandwidth of the main lobe of the Hanning window in formula 10 is only approximate, and it is further smaller actually.

It may be intuitively understood, in the time region, from the fact that a wave for repeating at interval of T is left over in the waveform after windowing. Among the waveforms applying window at W=2T, the waveforms in other portions than the central portion of the windowing section are high in correlation at interval T, which is the cause of leaving harmonic structure in the frequency region.

Therefore, at the window length of W=2T, the effect of pitch of original speed may rarely occur in the synthesized speech, and an echo-like sound may be generated.

This problem can be avoided, hence, by setting the window length W slightly smaller. Besides, when a uniform window length is used in cutting out all pitch waveforms, considering the fluctuations of pitch of original speech, it may be desired to define a smaller W in order to prevent from being W>2T. For example, supposing the mean pitch period of all waveforms to be Tavr, it may be considered to set at W=1.6 Tavr.

Using such window length, locally, the value may be very small, for example, W=1.4T. FIGS. 15(*a*)–15(*c*) show the spectrum of cut-out pitch waveform at W=1.4T. The envelope of the original spectrum of FIGS. 13(*a*)–13(*c*) is sufficiently expressed, and the spectrum shape is excellent, not inferior as compared with the case of W=2T in FIGS. 14(*a*)–14(*c*), and this is moreover superior as spectrum envelope.

In this method, the calculation in synthesis practically consists of additions only, and speech can be synthesized at high quality by an extremely small arithmetic processing quantity.

Operations necessary for synthesizing one sample of synthesized waveform are as follows. To generate one sample of pitch waveform, memory reading is required once for reading out the speech segment. The number of times of addition for superposing the element output is the number of elements—1. Hence, supposing the number of elements to be n, one sample of synthesized waveform required n times of memory access and (n−1) times of addition. Assuming n=4, the operation requires 4 times of memory access and 3 times of addition.

Figure 16:
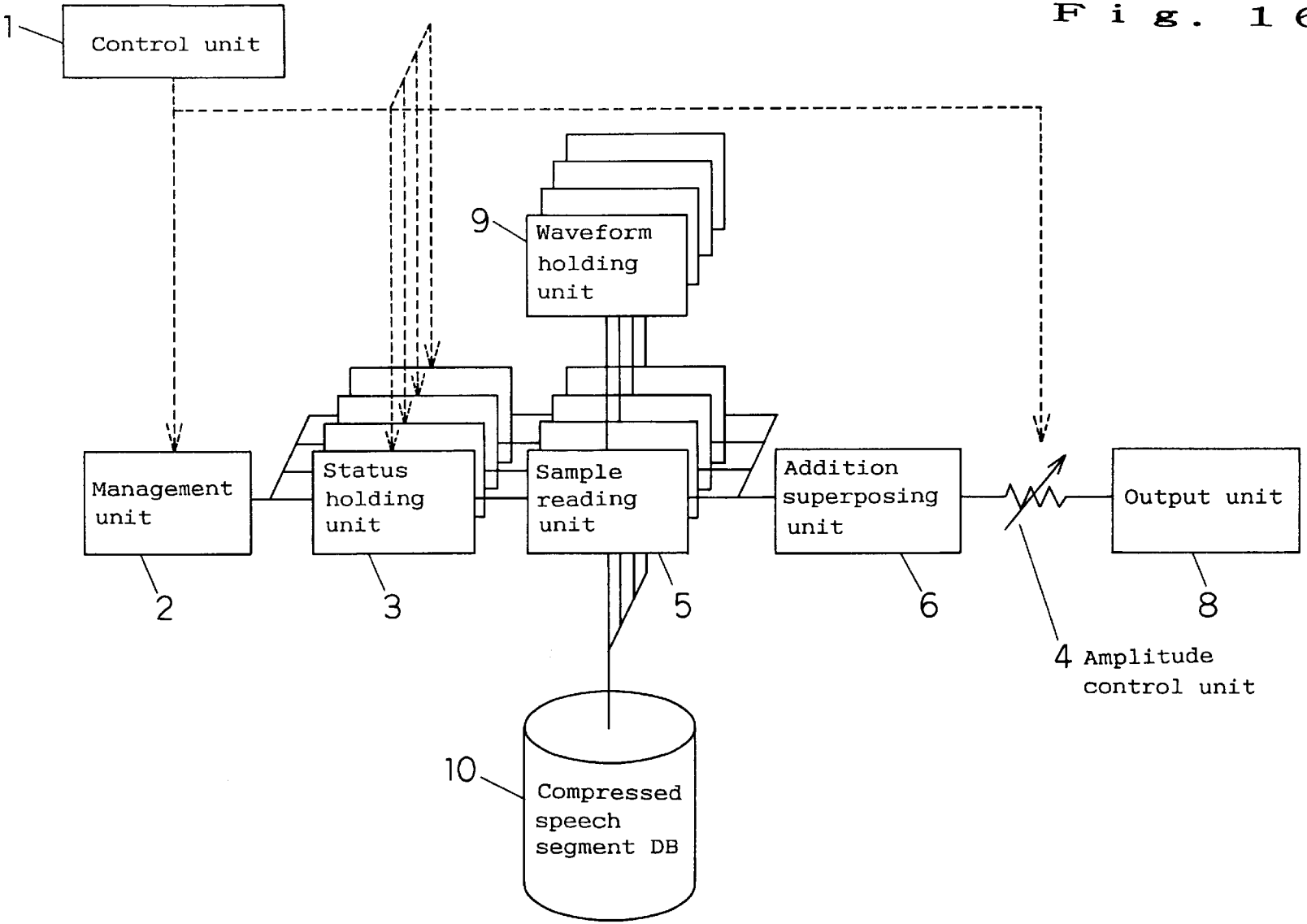
FIG. 16 is a block diagram of a speech synthesizing apparatus in a second embodiment of the invention.

A second embodiment of the invention is described below. FIG. 16 is a structural diagram of speech synthesizing apparatus in the second embodiment of the invention. This speech synthesizing apparatus comprises a control unit 1, of which output is connected to a management unit 2, plural status holding units 3, and an amplitude control unit 4. The management unit 2 connected to the plural status holding units 3, and these status holding units 3 are connected one by one to the same number of sample reading units 5. Waveform holding units 9 are provided as many as the sample reading units 5, and connected one by one to the sample reading units 5, and the outputs of the plural sample reading units 5 are combined into one and fed into an addition superposing unit 6. The output of the addition superposing unit 6 is fed to the amplitude control unit 4, and the output of the amplitude control unit 5 is fed to an output unit 8. A compressed speech segment DB 10 is provided, which is connected to all sample reading units 5.

Figure 17:
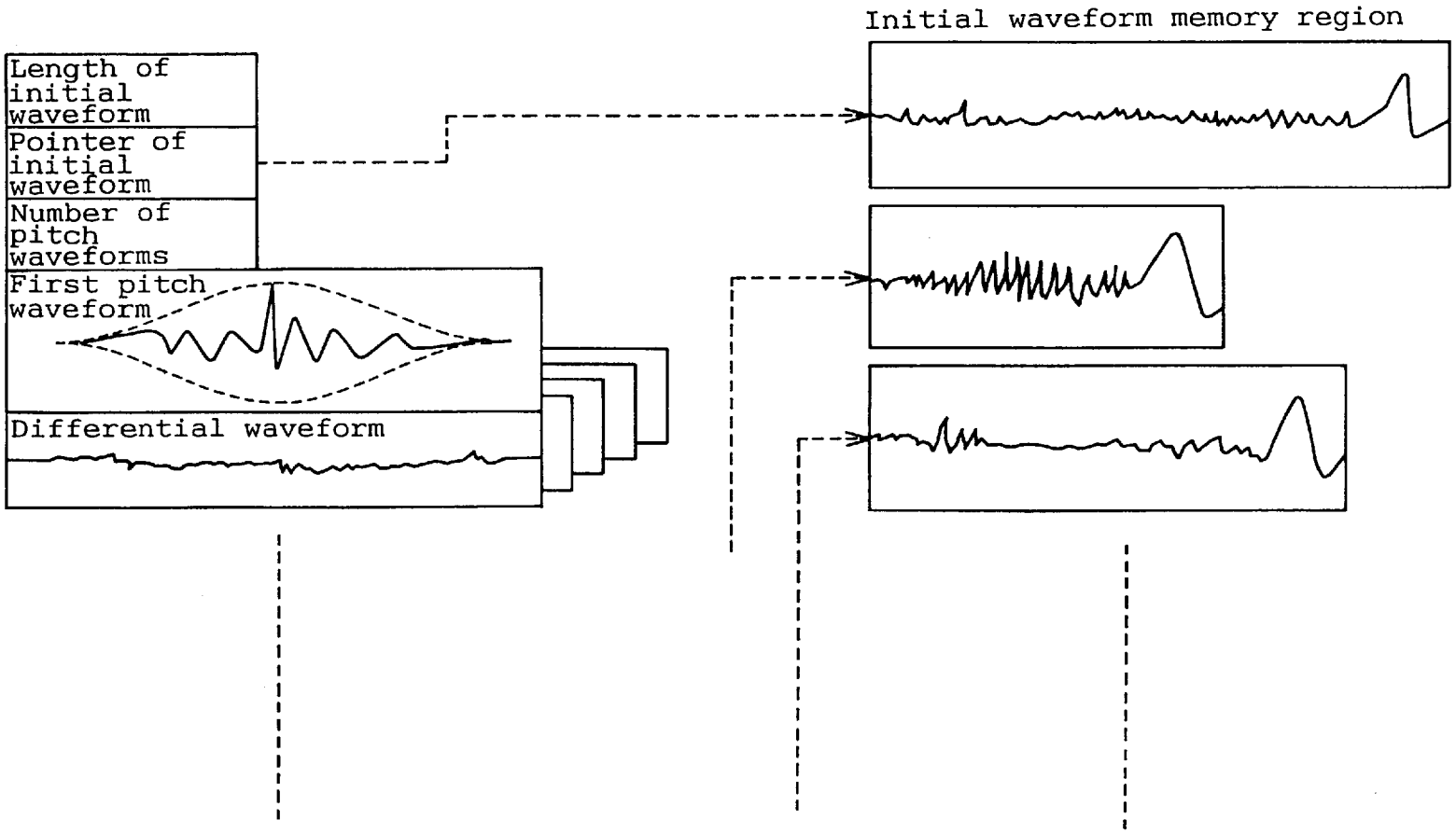
FIG. 17 is a diagram showing data structure of speech segment in compressed speech segment DB in the second embodiment.

In the compressed speech segment DB 10, speech segments are stored in a format as shown in FIG. 17. That is, the length of initial waveform, pointer of initial waveform, and number of pitch waveforms are stored same as in FIG. 7, while first pitch waveform and plural differential waveforms are stored instead of pitch waveforms. The initial waveform memory region is same as in FIG. 7.

The differential waveform is the data of the difference of adjacent pitch waveforms in FIG. 7. Since all pitch waveforms are cut out in the center of the peak, their difference expresses the waveform change between adjacent pitches. In the case of the speech waveform, since the correlation between adjacent pitches is strong, the differential waveform is extremely small in amplitude. Therefore, the number of bits per word assigned in the memory region can be decreased by several bits. Or, depending on the coding method, the number can be decreased to ½ or even ¼.

Using the compressed speech segment DB stored in such format, the procedure of actually reading out the waveform and synthesizing speech waveform is explained below. For synthesis of one sample, sample reading is processed sequentially in all elements.

Figure 18:
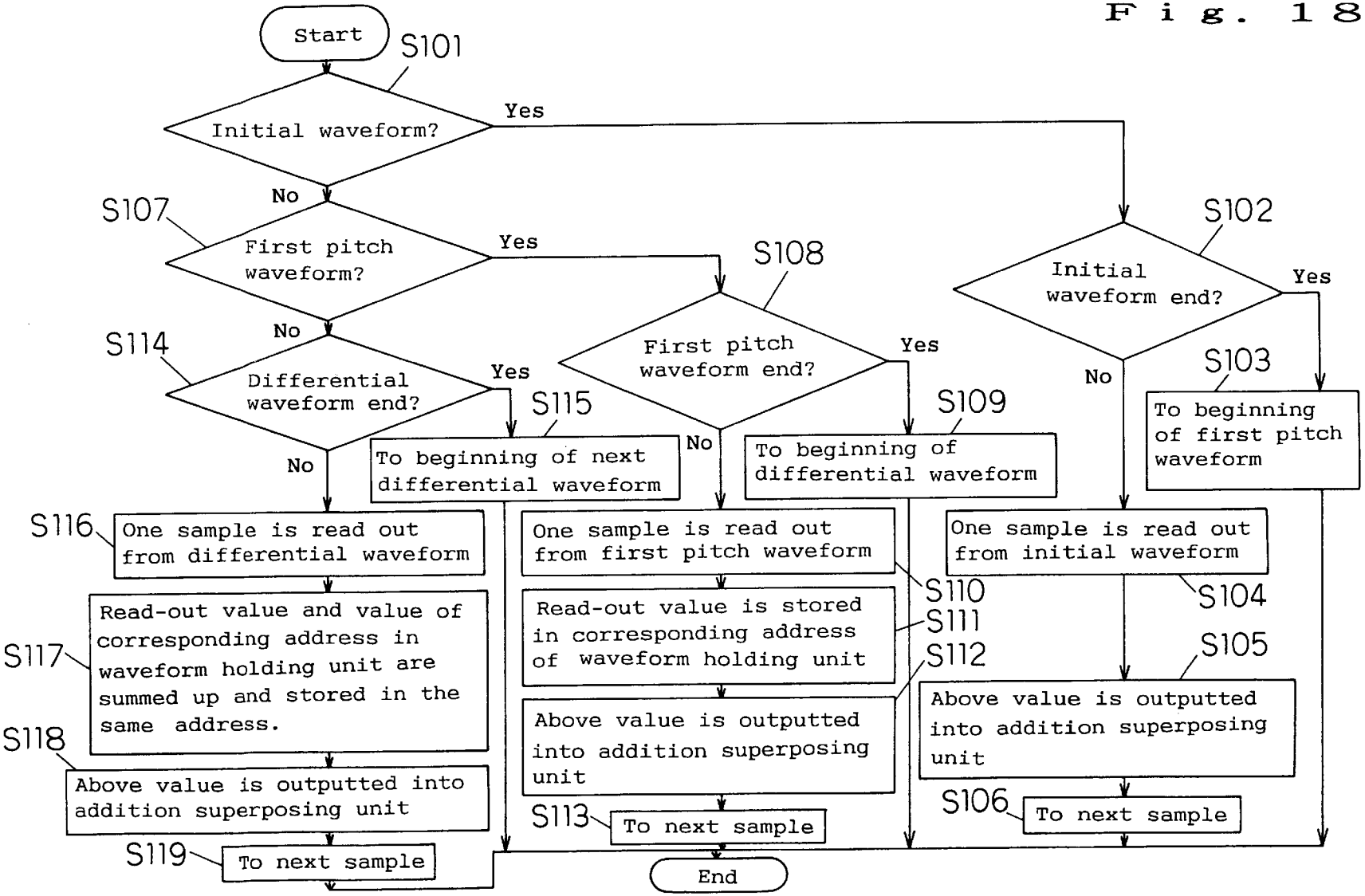
FIG. 18 is a flowchart showing processing of sample reading unit in the second embodiment.

First, suppose sample reading process is started right after speech segment change process and trigger process. In FIG. 18, judging whether initial waveform or not (step S101), if the initial waveform is terminated, the first pitch waveform is processed (steps S102, S103), and if not terminated (step S102), the pitch ID of the status holding unit 3 indicates the initial waveform, and hence one sample is read out from the initial waveform (step S104), and is outputted to the addition superposing unit 6 (step S105). At the same time, 1 is added to the read address in the status holding unit 3 (step S106), and processing is over. Thereafter, the same processing is done unless the read address exceeds the final address, and nothing is done if exceeding.

Then, suppose sample reading process is started in succession to the subsequent TG event. The pitch ID of the status holding unit 3 indicates other than the initial waveform as a matter of course. At the beginning, the first pitch waveform is shown (step S107). Therefore, one sample is read out from the first pitch waveform (step S110). If the first pitch waveform is terminated, the differential waveform is processed (step S109). Address updating is same as above, but the read value is temporarily stored in the waveform holding unit 9 (step S111). The waveform holding unit 9 is a memory region for the portion of one pitch waveform, and the value being read out from the n-th position counted from the beginning of the first pitch waveform is stored at the n-th position counted from the beginning of the waveform holding unit 9. The same value is outputted to the addition superposing unit 6 (step S112), and processing of next sample is started (step S113).

If the pitch ID is indicating a differential waveform (step S114), one sample is read out from the differential waveform (step S116). Herein, if one differential waveform is terminated, the next differential waveform is processed (step S115). Address updating is same as above. In the case of differential waveform, the read value and the value stored in the waveform holding unit 9 are summed up (step S117). As a result, the original waveform can be restored from the differential waveform. This value is stored again in the waveform holding unit 9 (step S117), and is also outputted to the addition superposing unit 6 (step S118). Then the operation goes to processing of next sample (step S119).

In this way, by accumulating the pitch waveforms in a format of differential waveforms, the required memory capacity can be reduced significantly. Incidentally, extra constituent elements and calculations required for this constitution as compared with the first embodiment are very slight, that is, a memory for one pitch waveform for each element, and once each of addition, reading of one word from memory, and storing of one word into memory per one process of sample reading.

The calculation necessary for synthesizing one sample of synthesized waveform is as follows. To generate one sample of pitch waveform, memory reading is required once for reading out the differential waveform, once is required each for memory reading and addition for summing it with the value of the waveform holding unit 9 and restoring the original waveform, and memory writing is needed once for storing the value again into the waveform holding unit 9. Supposing the number of elements to be n, one sample of synthesized waveform required 3n times of memory access, and n+(n−1) times of addition (addition for superposing n element outputs is required n−1 times). Assuming n=4, one sample of synthesized waveform requires 12 times of memory access and 15 times of addition. The calculation quantity is compared between the prior art and the invention in FIG. 19.

In the foregoing embodiments, the Hanning window is used as the window function, but not limited to this, other shape may be also used.

In the illustrated embodiments, as the types of events, only SC (speech change) and TG (trigger) are used, but other types may be also used, such as amplitude control information, and change information into speech segment set created from speech of other speaker.

Moreover, in these embodiments, the pitch change by addition superposition is effected on speech segments, but not limited to this, it may be also used, for example, in pitch change of vocal cord sound source waveform in formant synthesis.

Anyway, in this way, by finishing the windowing at the time of preparation of speech segments (let us call prior windowing method), the calculation quantity in synthesis can reduced dramatically, and hence sound quality deterioration can be suppressed low. Moreover, by calculating the difference between pitch waveforms, the speech segments can be compressed effectively, and it can be executed in a smaller memory quantity than in the prior art. What is more, by compressing the speech segments, the increase of calculation quantity in synthesis and apparatus scale is extremely small.

Thus, the calculation quantity is very small and the apparatus scale is also small, and it is possible to apply into small-sized speech synthesizing apparatus of high quality.

Herein, to realize small memory capacity and low calculation cost, it may be considered to combine the prior windowing method of the invention and the conventional hybrid method (prior windowing hybrid method). As a characteristic o the prior windowing hybrid method, however, there is an extremely large difference between the calculation cost of the connection synthesizing portion and the calculation cost of the parameter synthesizing portion, and the calculation quantity in synthesis fluctuates periodically. It means when the prior windowing hybrid method is applied in real-time synthesis, it requires the calculation capacity enough to absorb the magnitude of the calculation cost of the parameter synthesizing portion by the connection synthesizing portion, and the buffer memory enough to absorb the fluctuations of the calculation speed. To solve this problem, a third embodiment of the invention is described below while referring to the drawings.

Figure 20:
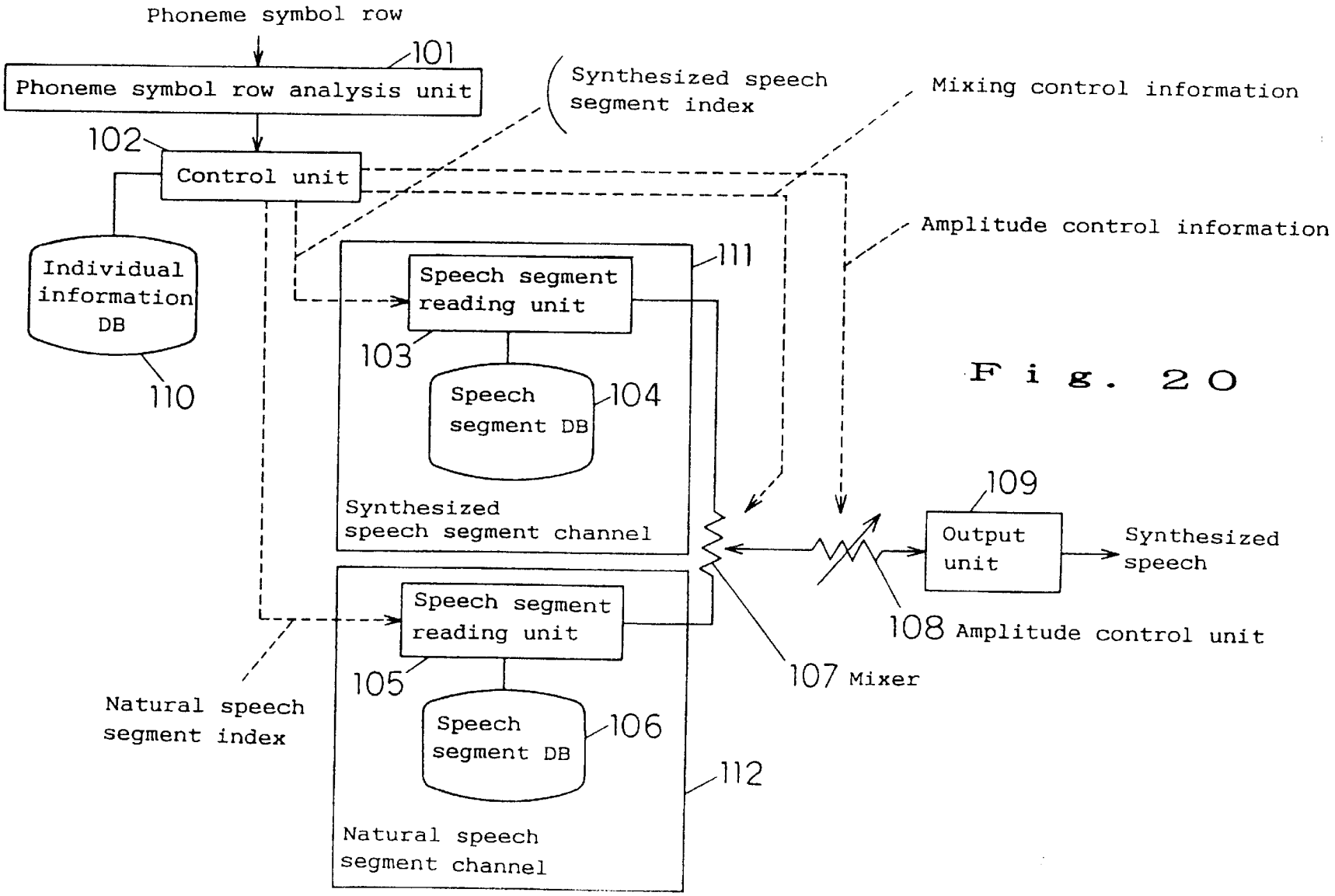
FIG. 20 is a block diagram of a speech synthesizing apparatus in a third embodiment of the invention.

FIG. 20 is a block diagram showing the speech synthesizing apparatus in the third embodiment of the invention. This speech synthesizing apparatus comprises a phoneme symbol row analysis unit 101, and its output is connected to the control unit 102. An individual information DB 110 is provided, and is mutually connected with the control unit 102. Moreover, a natural speech segment channel 112 and a synthesized speech segment channel 111 are provided, and a speech segment DB 106 and a speech segment reading unit 105 are provided inside the natural speech segment channel 112. Also inside the synthesized speech segment channel 111, a speech segment DB 104 and a speech segment reading unit 103 are provided. The speech segment reading unit 105 is mutually connected with the speech segment DB 106, and the speech segment reading unit 103 is mutually connected with the speech segment DB 104. The outputs of the speech segment reading unit 103 and speech segment reading unit 105 are connected to two inputs of a mixer 107, and the output of the mixer 107 is fed into the amplitude control unit 108. The output of the amplitude control unit 108 is fed to an output unit 109.

From the control unit 102, the natural speech segment index, synthesized speech segment index, mixing control information, and amplitude control information are outputted. Of these pieces of control information, the natural speech segment index is fed into the speech segment reading unit 105 of the natural speech segment channel 112, and the synthesized speech segment index is fed into the speech segment reading unit 103 of the synthesized speech segment channel 111. The mixing control information is fed into the mixer 107, and the amplitude control information is fed into the amplitude control unit 108.

Figure 22:
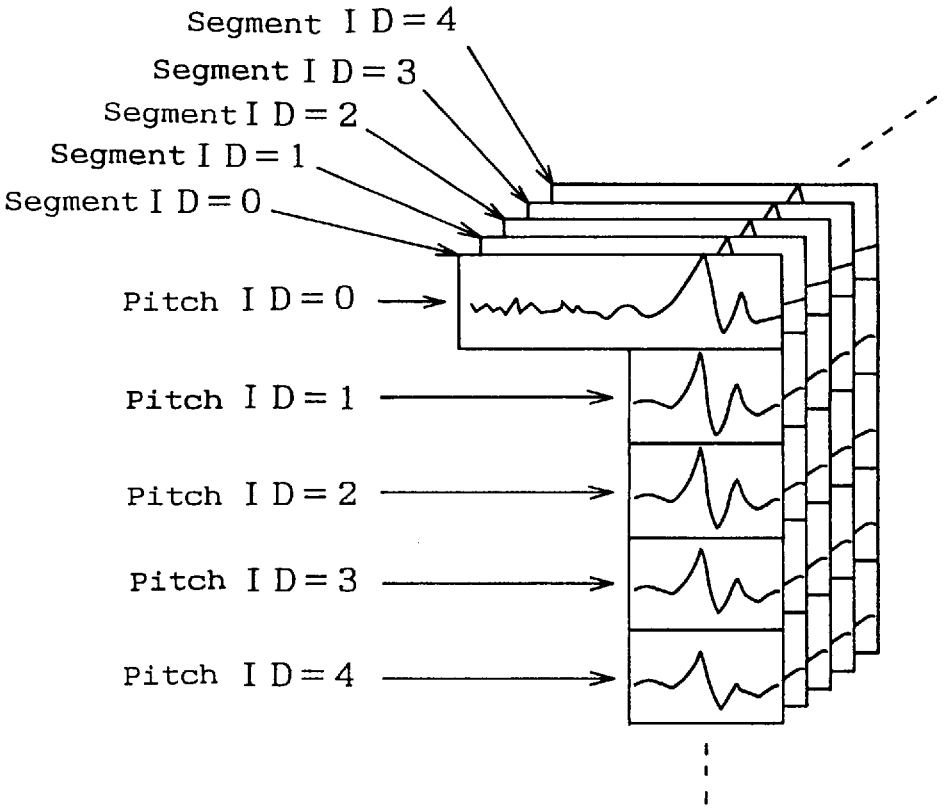
FIG. 22 is a data format diagram stored in speech segment DB in the third embodiment.

FIG. 22 shows the data format stored in the speech segment DB 106. The segment ID is, for example, a value of distinguishing each natural speech segment recorded in each syllable. There are plural pitch IDs for each segment ID. The pitch ID is a value for distinguishing the pitch waveforms being cut out by windowing from the beginning of the natural speech segment sequentially from 0.

Figure 23:
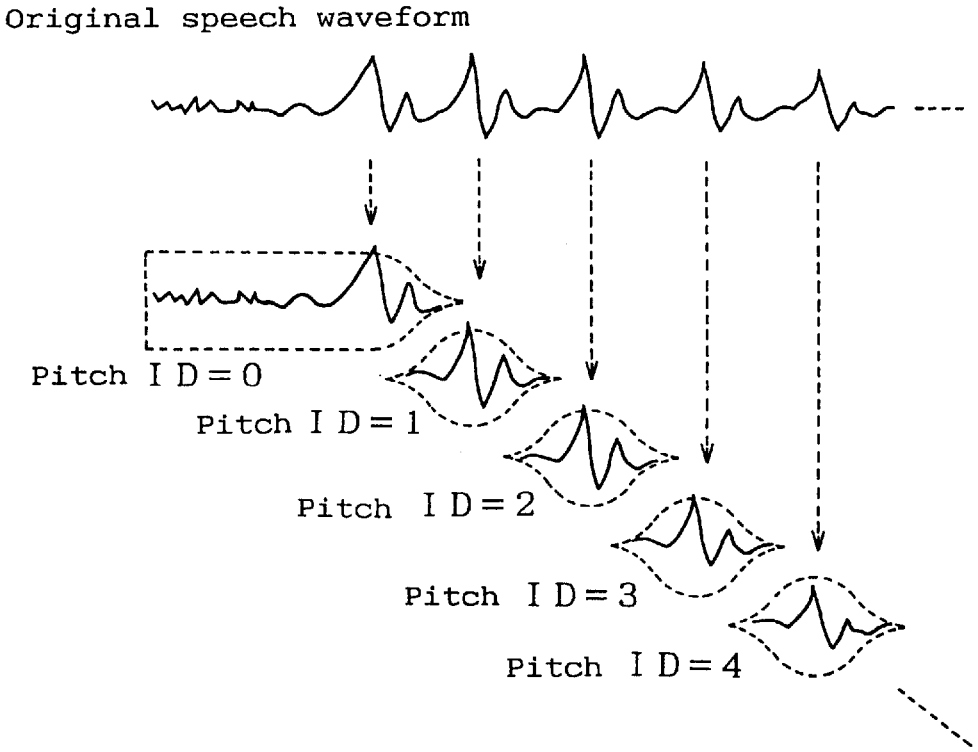
FIG. 23 is a waveform diagram showing the mode of cutting out pitch waveform by windowing from natural speech waveform.

FIG. 23 shows the mode of cutting out the pitch waveform by windowing. The top figure in FIG. 23 is the original speech waveform subjected to cutting out. The waveform in which the pitch ID corresponds to 0 may contain the beginning portion of a consonant as shown in FIG. 23, and hence the beginning portion is cut out in a long asymmetrical window. After the pitch ID is 1, it is cut out in the Hanning window of about 1.5 to 2.0 times of the pitch period at that moment. In this way, the natural speech segment of the portion of one segment ID is created. Similarly, by operating in this way in plural waveforms, the speech segment DB 106 is created.

Figure 24:
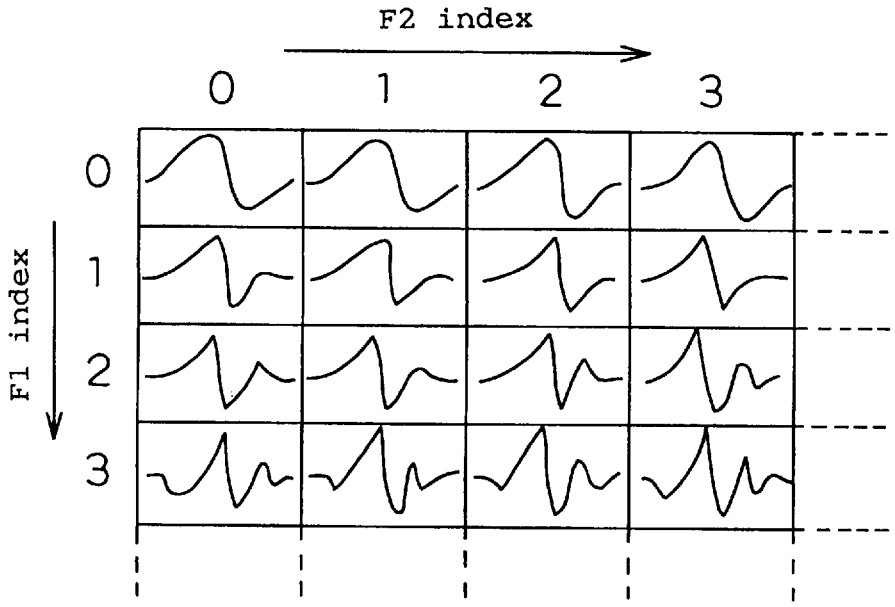
FIG. 24 is a data format diagram stored in speech segment DB4 in the third embodiment.

In succession, FIG. 24 shows the format of the data stored in the speech segment DB 104. The pitch waveform is arranged on a plane plotting the F1 index and F2 index on axes as shown in the diagram.

The F1 index and F2 index correspond to first formant frequency and second formant frequency of speech, respectively. As the F1 index increases 0, 1, 2, the first formant frequency becomes higher. It is the same in the F2 index. That is, the pitch waveform stored in the speech segment DB 104 is set by two values of F1 index and F2 index.

Figure 25:
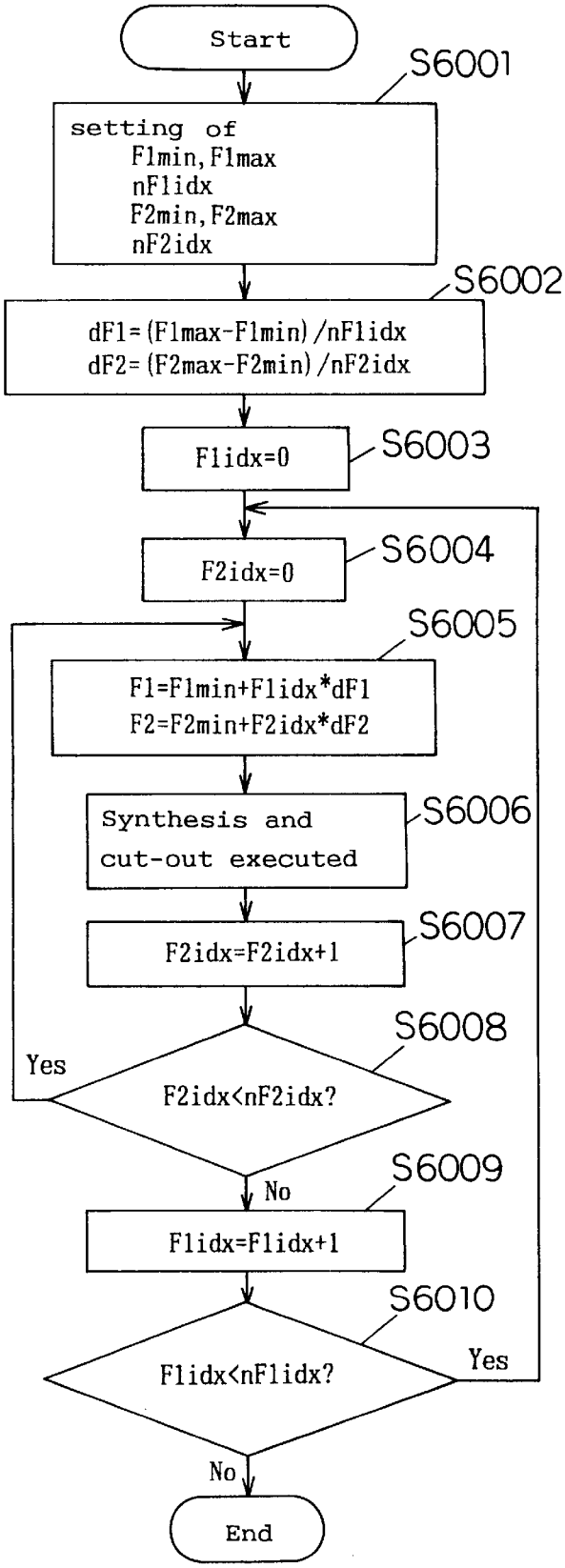
FIG. 25 is a flowchart showing a generation algorithm of pitch waveform stored in speech segment DB4 in the third embodiment.

The waveforms thus expressed by F1 index and F2 index are created by formant synthesis beforehand. The algorithm of such processing is explained below while referring to the flowchart in FIG. 25.

To begin with, the minimum value and maximum value of the first and second formant frequencies are determined. These values are determined from the individual data of the speaker when the natural speech segments are recorded. Next, the number of classes of F1 index and F2 index is determined. This value is proper at around 20 for both (so far step S6001).

From the values determined at step S6001, the step width of the first formant frequency and second formant frequency is determined (step S6002). Then, the F1 index and F2 index are initialized to 0 (step S6003, and step S6004), and the first formant frequency and second formant frequency are calculated according to the formula at step S6005. Using thus obtained formant parameters, the formants are synthesized at step S6006, and the pitch waveform is cut out from this waveform.

Consequently, adding 1 to the F2 index (step S6007), processing after step S6005 is repeated. When the F2 index exceeds the number of classes (step S6008), 1 is added to the F1 index (step S6009). Afterwards, the processing after step S6004 is repeated. If the F1 index exceeds the number of classes, the processing is over.

Thus, the possible range of the first formant frequency and second formant frequency is equally divided, and by synthesizing the waveforms covering all possible combinations of these two values, the speech segment DB 104 is built up.

Processing at step S6006 is as follows. First, parameters other than the first formant frequency and second formant frequency are determined from the individual data of the speaker of the natural speech segments. The parameters include the first formant bandwidth, second formant bandwidth, third to sixth formant frequencies and bandwidths, and pitch frequency, among others.

As the parameter, the mean of the speaker may be used. Characteristically, the first and second formant frequencies change significantly depending on the kind of vowel, and the third and higher formant frequencies are smaller in change. The first and second formant bandwidths change significantly by the vowel, but the effect on the hearing sense is not so great as that of formant frequency. That is, if the first and second formant frequencies are deviated, the phonological property (the degree of ease of hearing speech as a specific phoneme) drops notably, but the first and second formant bandwidths will not lower the phonological property so much. Therefore, other parameters than the first and second formant frequencies are fixed.

Using the first and second formant frequencies calculated at step S6005 and the above fixed parameters, the speech waveform is synthesized for several pitch periods. From thus synthesized waveforms, a pitch waveform is cut out by using the window function in the same manner as when cutting out the pitch waveform of the natural speech segment in FIG. 23. Herein, only one pitch waveform is cut out. Every time the loop from step S6005 to step S6008 is executed once, one synthesized speech segment corresponding to the combination of F1 index and F2 index is generated.

As the sound source waveform used in formant synthesis, meanwhile, general functions may be used, but it is preferable to use waveforms extracted by an vocal tract revers filter from the speech of the speaker when recording the natural speech segments. The vocal tract reverse filter is th waveform obtained as a result of removal of transmission characteristic from the sound waveform, by using the reverse function of the transmission function in the vocal tract mentioned in the Prior Art. This waveform expresses the vibration waveform of vocal cord. By using the waveform directly as the sound source of formant synthesis, the synthesized waveform reproduces the individual characteristic of the speaker at an extremely high fidelity. In this way, the speech segment DB 104 is built up.

The operation of thus constituted speech synthesizing apparatus is explained below. First, when the phoneme symbol row is put into the phoneme symbol row analysis unit 101, the phoneme information, time length information, and pitch information corresponding to the input are outputted to the control unit 102. FIG. 21 shows an example of information analyzed in the phoneme symbol row analysis unit 101 and outputted to the control unit 102. In FIG. 21, the phoneme symbol row is an input character string. In this example, it is expressed in katakana. The phoneme information is a value expressing the phoneme corresponding to the phoneme symbol row. In this example, corresponding to each character of katakana, that is, in the syllable unit, the value is determined. The time length is the duration time of each syllable. In this example, it is expressed in milliseconds. This value is determined by the speed of utterance, statistic data of each phoneme, and label information of natural speech segment. The start pitch and middle pitch are the pitch at the start of syllable and middle of syllable, and expressed in hertz (Hz) in this example.

The control unit 102 generates the control information, from these pieces of information and the individual information stored in the individual information DB 110, such as natural speech segment index, synthesized speech segment index, mixing control information, and amplitude control information. In the individual information DB 110, in each natural speech segment, the first and second formant frequencies of vowel, type of consonant of the starting portion, and others are stored. The natural speech segment index is the information indicating a proper natural speech segment corresponding to the phoneme information. For example, corresponding to the first phoneme information /a/ in FIG. 21, the value indicating the natural speech segment created by the sound 'あ' is outputted.

Figure 26:
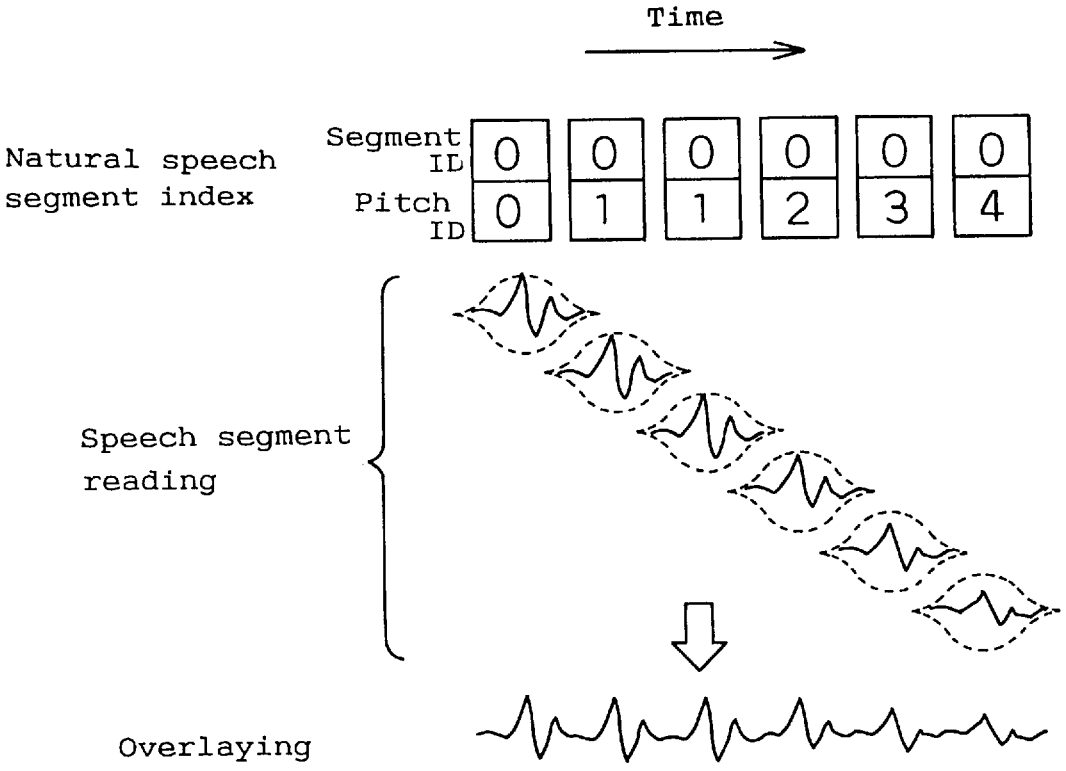
FIG. 26 is a waveform diagram showing an example of natural speech segment index, and the mode of synthesis of natural speech segment channel waveform.

At the same time, the natural speech segment index also includes the pitch ID information, and a smooth pitch change is created by interpolating the starting pitch and middle pitch, and the information for reading out the pitch waveform at a proper timing from the information is outputted to the speech segment reading unit 105. The speech segment reading unit 105 reads out the waveforms successively from the speech segment DB 106 according to the information, and overlaps the waveforms to generate a synthesized waveform of the natural speech segment channel 112. An example of natural speech segment index is shown in FIG. 26, together with the mode of reading out the natural speech segment accordingly, and synthesizing as the waveform of the natural speech segment channel 112.

The synthesized speech segment index is the information indicating a proper synthesized speech segment corresponding to the phoneme information. The essence of this information is the first and second formant frequencies. It is actually the formant frequency information converted into corresponding formant indices. The formant indices are the ones used in FIG. 25, and expressed in formulas 11 and 12. F1idx is the first formant index, and F2idx is the second formant index.

[11] F1idx=(F1−F1min)/(F1max−F1min)*nF1idx

[12] F2idx=(F2−F2min)/(F1max−F2min)*nF2idx

Figures 27A, 27B:
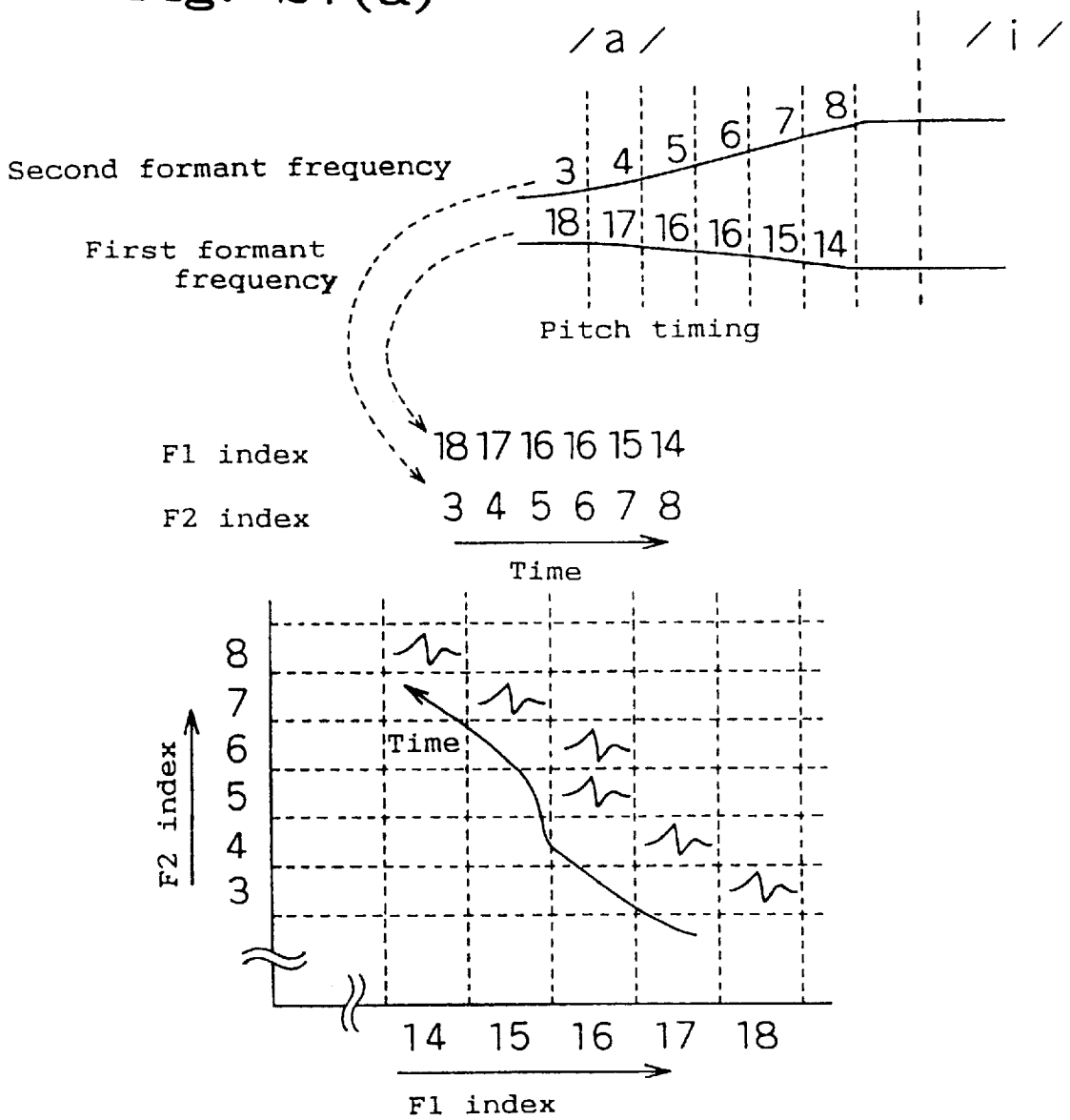
FIGS. 27(*a*) and 27(*b*) are waveform diagrams showing an example of synthesized speech segment index, and the mode of synthesis of synthesized speech segment channel waveform.

F1 and F2 are respectively first formant frequency and second formant frequency, and they are determined by the first and second formant frequencies of the vowel of the natural speech segment synthesized at this time, and the type of the consonant connected next. These pieces of information are obtained by referring to the individual information DB 110. More specifically, in the transient area from vowel to consonant, the formant frequency of the vowel is picked from the individual information DB 110, and starting from this value, the pattern of the formant frequency changing toward the consonant is created by a rule, and the locus of the formant frequency is drawn accordingly. At the timing of each segment determined by the locus and pitch information, the formant frequency at that moment is calculated. An example of thus created synthesized speech segment index information, and the mode of synthesizing the waveform of the synthesized speech segment channel 111 accordingly are shown in FIGS. 27(*a*) and (*b*).

Figure 28:
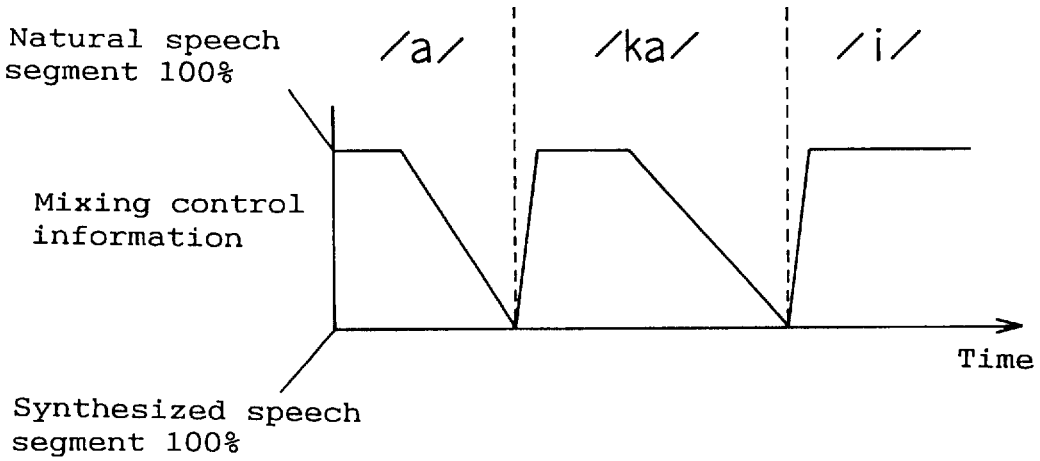
FIG. 28 is a graph of an example of mixed control information in the third embodiment.

The mixing control information is generated as shown in FIG. 28. That is, the mixing ratio is completely controlled in the natural speech segment channel 112 from start to middle of each syllable, and is gradually shifted to the synthesized speech segment channel 111 from middle to end. From end to start of next syllable, it is returned to the natural speech segment channel 112 side in a relatively short section. Thus, the principal portion of each syllable is the natural speech segment, and the changing portion to the next syllable is linked smoothly by the synthesized speech segment.

Finally, the amplitude of the entire waveform is controlled by the amplitude control information, and speech waveform is outputted from the output unit 109. The amplitude control information is used for the purpose of reducing the amplitude smoothly, for example, at the end of a sentence.

As explained herein, the synthesized speech segment waveform used in linking of syllables must be synthesized in real time in the prior art, but in the embodiment, it can be generated at an extremely low cost by connecting the waveforms changing moment by moment while reading out in every pitch. In a different prior art, since such splicing portion is included at the natural speech segment side, the speech segment DB of a very large capacity was needed, but in the embodiment, since the data of the natural speech segment is basically structured in the CV unit, the required capacity is small. For this purpose, the synthesized speed segment must be held, but the required capacity is only enough for holding 400 pitch waveforms in this embodiment, supposing both F1 index and F2 index to be 20, and hence the required memory capacity is extremely small.

Figure 29:
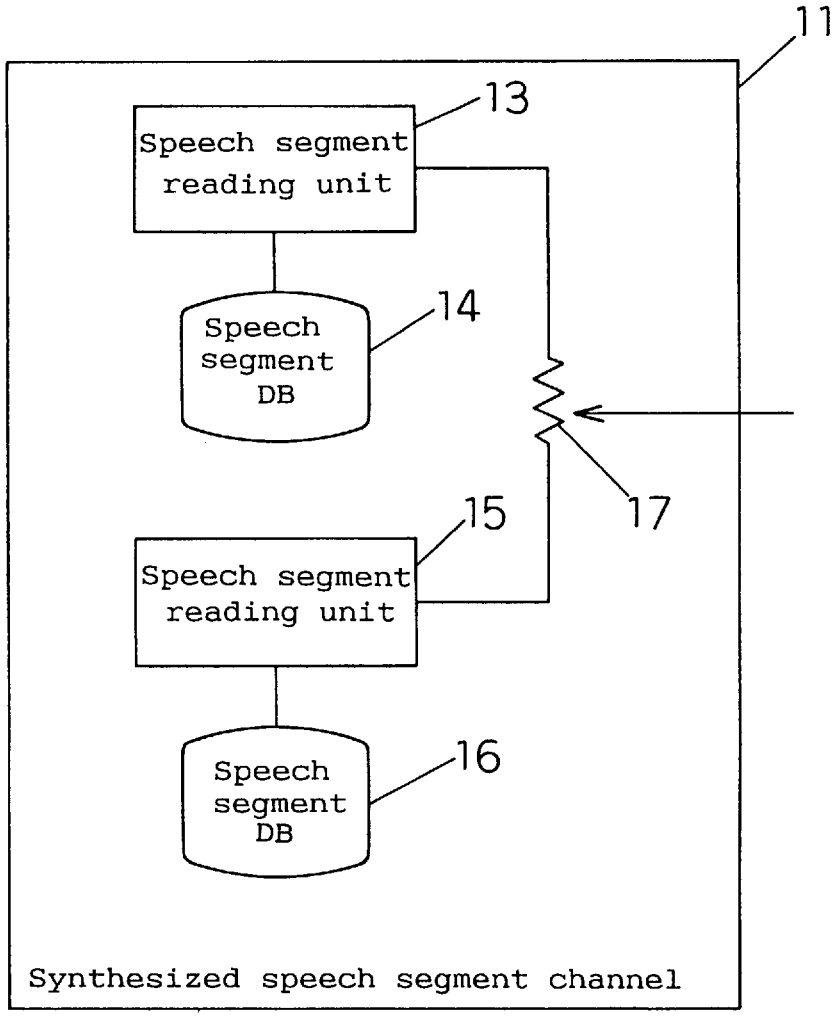
FIG. 29 is a block diagram showing an example of synthesized speech segment channel in a fourth embodiment of the invention.

FIG. 29 shows an example of synthesized speech segment channel 111 in a fourth embodiment. Herein, a first speech segment reading unit 113 and a second speech segment reading unit 115 are provided. A first speech segment DB 114 is connected to the first speech segment reading unit 113, and a second speech segment DB 116 is connected to the second speech segment reading unit 115. A mixer 117 is also provided, and to its two inputs, the outputs of the first speech segment reading unit 113 and second speech segment reading unit 115 are connected. The output of the mixer 117 is the output of the synthesized speech segment channel 111.

The synthesized speech segments stored in the first speech segment DB 114 and second speech segment DB 116 are respectively composed of the same F1 index and F2 index, but are synthesized by using different sound source waveforms. That is, the sound source used in the first speech segment DB 114 is extracted from the speech uttered in an ordinary style, whereas the sound source used in the second speech segment DB 116 is extracted from the speech uttered weakly.

Such difference of sound sources is a general tendency of the frequency spectrum. When uttered strongly, the sound source waveform contains many higher harmonics up to high frequency, and the spectrum inclination is small (nearly horizontal). When uttered weakly, on the other hand, higher harmonics in sound source waveforms are few, and the spectrum inclination is large (dropping toward the higher frequency direction).

In actual speech, the spectrum inclination of sound source changes moment after moment during utterance, and to simulate such characteristics, it may be considered to mix while varying the ratio of two sound source waveforms. In this embodiment, since the synthesized speech segment channel uses the waveform synthesized beforehand, the same effect is obtained by mixing later the synthesized waveforms synthesized by sound source waveforms having two characteristics. By thus constituting, it is possible to simulate the changes of spectrum inclination, from beginning to end of sentence or by nasal sound or the like.

In the third and fourth embodiments, the formant synthesis is used in creation of synthesized speech segment, but it may be any synthesizing method belonging to parameter synthesis, for example, LPC synthesis, PARCOR synthesis, and LSP synthesis At this time, instead of using the sound source waveform extracted by using the vocal tract reverse filter, the LPC residual waveform may be used.

In the synthesized speech segments, segments are designed to correspond to all combinations of F1 index and F2 index, but physically unlikely combinations also exist between the first formant frequency and second formant frequency, and combinations of low probability of occurrence are also present, and therefore such segments are not needed. As a result, the memory capacity can be further decreased. Moreover, by investigating the probability of occurrence, the space on the basis of the first formant and second formant can be divided non-uniformly by vector quantizing or other technique, and hence the memory can be utilized more effectively, and the synthesizing quality can be enhanced.

In the third embodiment, as the parameter axis of synthesized speech segment, the first formant frequency and second formant frequency are used, and in the fourth embodiment, the spectrum inclination of sound source is used, but further parameters may be added if the memory capacity has an extra space. For example, by adding a third formant frequency aside from the first formant frequency and second formant frequency, the resulting three-dimensional space may be divided, and the synthetic speech segment can be built up. Or, when desired to change the sound source characteristic other than the spectrum inclination, for example, to change the chest voice and falsetto, separate synthesized speech segments may be structured from different sound sources, and mixed when synthesizing.

In the third and fourth embodiments, providing the individual information DB 110, the synthesized speech segment index is created by using the formant frequency of the natural speech segments of the speech segment DB 106, but since the formant frequency is generally determined when the vowel is decided, it may be replaced by providing the formant frequency table for each vowel.

What is claimed is:

1. A speech synthesizing method characterized by:

storing natural speech segments prepared by cutting out prerecorded speech waveforms in each specific syllable chain, by a natural speech segment memory unit, storing speech segments which have been previously prepared by dividing N-dimensional space S, N being a positive integer, built up by a parameter vector P composed of N parameters into M regions $A_O$ to $A_{M-1}$, M being a positive integer, and generates a parameter vector $P_i$ corresponding to a desired position in a region $A_i$ for all integers i changing from 0 to M−1, and generating a synthesized waveform according to the parameter vector $P_i$, and synthesizing speech while connecting the natural speech segments and synthesized speech segments, in a connection synthesis unit.

2. A speech synthesizing method of claim 1, wherein the connection synthesis unit synthesizes speech by making use of a natural speech segment parameter memory unit for storing parameters of the natural speech segments stored in the natural speech segment memory unit, and a synthesized speech segment parameter memory unit for storing parameters of the synthesized speech segments stored in the synthesized speech segment memory unit, the parameters stored in the natural speech segment parameter memory unit and synthesized speech segment parameter memory unit are same or same combinations, and the connection synthesis unit interpolates the difference of mutual parameters at the junction over a specific time section when connecting two natural speech segments each other, reads out the synthesized speech segment synthesized by the parameter closest to the combination of the interpolated parameters at each timing from the synthesized speech segment memory unit, and connect the two natural speech segments by the synthesized speech segment being read out.

3. A speech synthesizing method of claim 1, wherein the synthesized speech segment memory unit stores the synthesized speech segments created by the speech segment preparing method for preparing speech segments by utilizing a parameter generating unit for generating parameters, a speech synthesizing unit for generating synthesized waveforms according to the parameters generated by the parameter generating unit, a waveform memory unit for storing the synthesized waveforms and a parameter memory unit for storing the values of the parameters corresponding to the synthesized waveforms, wherein the parameter generating unit divided N-dimensional space S (N being a positive integer) built up by a parameter vector P composed of N parameters into M regions $A_O$ to $A_{M-1}$ (M being a positive integer), and generates a parameter vector $P_i$ corresponding to a desired position in a region $A_i$ for all integers i changing from 0 to M−1, the speech synthesizing unit generates a synthesized waveform according to the parameter vector $P_i$, the waveform memory unit stores the synthesized waveform, the parameter memory unit stores the parameter vector $P_i$ corresponding to the synthesized waveform, said speech synthesizing unit is a by formant synthesizing method, and wherein said speech synthesizing unit extracts vocal tract transmission characteristic from the natural speech waveform, composes a vocal tract inverse filter having a reve characteristic, removes the vocal tract transmission characteristic from the natural speech waveform by the vocal tract inverse filter, and uses the vibration waveform obtained as a result of a vibration sound source waveform, and the natural speech segment stores in the natural speech segment memory unit and the excitation sound source waveform in the speech synthesizing unit are uttered by a same speaker.

4. A speech synthesizing method of claim 3, wherein the synthesized speech segment parameter memory unit stores the parameters of said synthesized speech segments.

5. A speech synthesizing apparatus comprising a synthesized speech segment memory unit for storing natural speech segments prepared by cutting out prerecorded speech waveforms in each specific syllable chain, a natural speech segment memory unit for storing speech segments prepared by the speech segment preparing method of claim 23, and a connection synthesis unit for synthesizing speech while connecting the natural speech segments and synthesized speech segments.

6. A speech synthesizing apparatus of claim 5, comprising:

a natural speech segment parameter memory unit for storing parameters of the natural speech segments stored in the natural speech segment memory unit, and a synthesized speech segment parameter memory unit for storing parameters of the synthesized speech segments stored in the synthesized speech segment memory unit, wherein the parameters stored in the natural speech segment parameter memory unit and synthesized speech segment parameter memory unit are same or same combinations, and the connection synthesis unit interpolates the difference of mutual parameters at the junction over a specific time section when connecting two natural speech segments each other, reads out the synthesized speech segment synthesized by the parameter closest to the combination of the interpolated parameters at each timing from the synthesized speech segment memory unit, and connect the two natural speech segments by the synthesized speech segment being read out.

7. A speech synthesizing apparatus of claim 5, wherein the synthesized speech segment memory unit stores the synthesized speech segments created by the speech segment preparing method for preparing speech segments by utilizing a parameter generating unit for generating parameters, a speech synthesizing unit for generating synthesized waveforms according to the parameters generated by the parameter generating unit, a waveform memory unit for storing the synthesized waveforms and a parameter memory unit for storing the values of the parameters corresponding to the synthesized waveforms, wherein the parameter generating unit divided N-dimensional space S (N being a positive integer) built up by a parameter vector P composed of N parameters into M regions $A_0$ to $A_{M-1}$ (M being a positive integer), and generates a parameter vector $P_i$ corresponding to a desired position in a region $A_i$ for all integers i changing from 0 to M−1, the speech synthesizing unit generates a synthesized waveform according to the parameter vector $P_i$, the waveform memory unit stores the synthesized waveform, the parameter memory unit stores the parameter vector $P_i$ corresponding to the synthesized waveform, said speech synthesizing unit is a by formant synthesizing method, and wherein said speech synthesizing unit extracts vocal tract transmission characteristic from the natural speech waveform, composes a vocal tract inverse filter having a reve characteristic, removes the vocal tract transmission characteristic from the natural speech waveform by the vocal tract inverse filter, and uses the vibration waveform obtained as a result of a vibration sound source waveform, and the natural speech segment stores in the natural speech segment memory unit and the excitation sound source waveform in the speech synthesizing unit are uttered by a same speaker.

8. A speech synthesizing apparatus of claim 7, wherein the synthesized speech segment parameter memory unit stores the parameters of said synthesized speech segments.

* * * * *

UNITED STATES PATENT AND TRADEMARK OFFICE

CERTIFICATE OF CORRECTION

PATENT NO. : 5,864,812

DATED : January 26, 1999

INVENTOR(S) : KAMAI et al.

It is certified that error appears in the above-identified patent and that said Letters Patent is hereby corrected as shown below:

Column 20, line 37 change "natural" to --synthesized--.

lines 38 and 39 change "cutting out prerecorded speech waveforms in each specific syllable chain" to --the speech segment preparing method of claim 1--.

line 40 after "storing" insert --natural--.

lines 41 and 42 change "the speech segment preparing method of claim 23" to --cutting out prerecorded speech waveforms in each specific syllable chain.--

Signed and Sealed this

Second Day of January, 2001

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,864,812
DATED : January 26, 1999
INVENTOR(S) : Takahiro Kamai et al.

It is certified that error appears in the above-identified patent and that said Letters Patent is hereby corrected as shown below:

Column 20,
Line 5, change “divided” to -- divides --.

Signed and Sealed this

Eighteenth Day of November, 2003

JAMES E. ROGAN
*Director of the United States Patent and Trademark Office*